US007650087B2

(12) United States Patent
Nagata et al.

(10) Patent No.: US 7,650,087 B2
(45) Date of Patent: Jan. 19, 2010

(54) CONTROL METHOD OF DRIVING TONER CONTAINERS AND IMAGE FORMING APPARATUS

(75) Inventors: Jinichi Nagata, Osaka (JP); Yasunobu Ohkawa, Nara (JP); Yasuhiro Takai, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 196 days.

(21) Appl. No.: 11/822,792

(22) Filed: Jul. 10, 2007

(65) Prior Publication Data

US 2008/0212989 A1 Sep. 4, 2008

(30) Foreign Application Priority Data

Jul. 11, 2006 (JP) ..... 2006-190304

(51) Int. Cl.
*G03G 15/08* (2006.01)

(52) U.S. Cl. ..... 399/27; 399/119; 399/258

(58) Field of Classification Search ..... 399/119, 399/120, 27, 262, 258, 53
See application file for complete search history.

(56) References Cited

U.S. PATENT DOCUMENTS 5,909,609 A * 6/1999 Yahata et al. ..... 399/258
6,091,912 A * 7/2000 Kitajima et al. ..... 399/119 X
2005/0135841 A1* 6/2005 Murakami et al. ..... 399/258
2007/0058997 A1* 3/2007 Sakita et al. ..... 399/27
2007/0230974 A1* 10/2007 Ohkawa et al. ..... 399/27

FOREIGN PATENT DOCUMENTS

JP 03-220577 9/1991
JP 06-102756 A * 4/1994
JP 2005-316230 A * 11/2005

* cited by examiner

*Primary Examiner*—Sophia S Chen
(74) *Attorney, Agent, or Firm*—Nixon & Vanderhye, PC

(57) ABSTRACT

The purpose is to provide a control method of driving toner containers for use in an apparatus including a plurality of toner containers each filled with toner and detachably mounted thereinto from a toner container covering structure; and a toner supply device for supplying toner to a developing unit while rotating the plurality of toner container. This method includes the step of detecting a first toner container whose toner has run out, among the plurality of toner containers. When the first toner container has been detected, this method makes a control including the steps of: opening the toner container covering structure; stopping the rotational motion of the first toner container; and continuing the rotational motion of a second toner container or containers other than the first toner container.

14 Claims, 25 Drawing Sheets

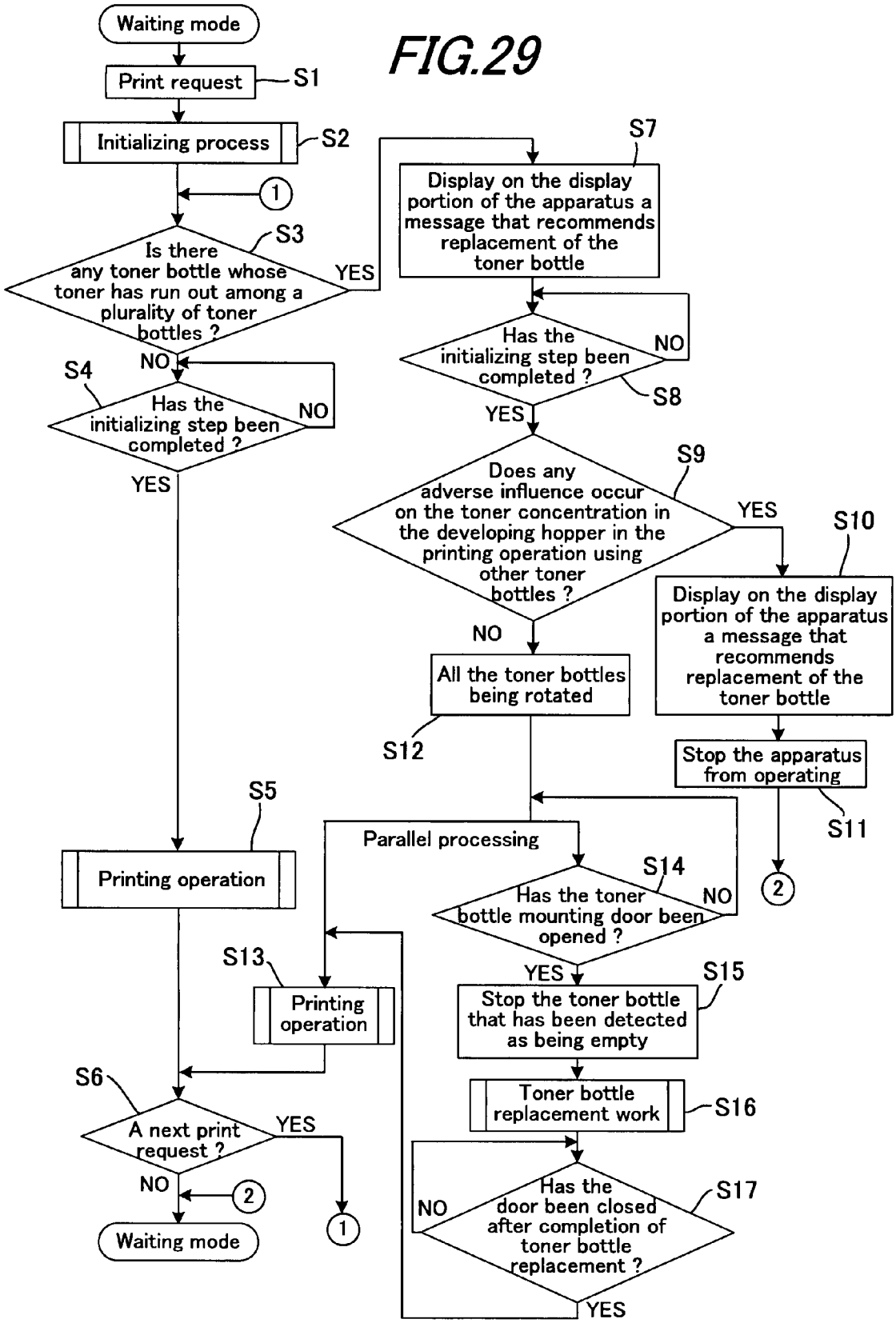
FIG.29
Waiting mode
Print request
S1
Initializing process
S2
1
Is there any toner bottle whose toner has run out among a plurality of toner bottles ?
S3
YES
NO
S4
Has the initializing step been completed ?
NO
YES
S5
Printing operation
S6
A next print request ?
YES
NO
2
Waiting mode
1
S7
Display on the display portion of the apparatus a message that recommends replacement of the toner bottle
Has the initializing step been completed ?
NO
S8
YES
Does any adverse influence occur on the toner concentration in the developing hopper in the printing operation using other toner bottles ?
S9
YES
S10
Display on the display portion of the apparatus a message that recommends replacement of the toner bottle
NO
All the toner bottles being rotated
S12
Stop the apparatus from operating
S11
2
Parallel processing
S13
Printing operation
S14
Has the toner bottle mounting door been opened ?
NO
YES
S15
Stop the toner bottle that has been detected as being empty
Toner bottle replacement work
S16
Has the door been closed after completion of toner bottle replacement ?
S17
NO
YES

CONTROL METHOD OF DRIVING TONER CONTAINERS AND IMAGE FORMING APPARATUS

This Nonprovisional application claims priority under 35 U.S.C. §119(a) on Patent Application No. 2006-190304 filed in Japan on 11 Jul. 2006, the entire contents of which are hereby incorporated by reference.

BACKGROUND OF THE TECHNOLOGY

1. Field of the Technology

The present technology relates to a control method of driving toner containers and an image forming apparatus using the drive control method.

2. Description of the Prior Art

Recently, there have been increased demands for image forming apparatuses capable of high-speed operations, and as the number of printing (per unit time) increases the speed of the paper to be conveyed has been also enhanced. For example, conventionally the processing ability of an image forming apparatus with not lower than 60 sheets per minute (A4 short-edge feed) was previously regarded as a high-speed machines, but nowadays, the situation has changed and the machines having a processing speed of 80 sheets per minute or greater should be regarded as high-speed ones, and further, machines having a speed of 100 sheets per minute are being developed.

Since a large amount of toner is consumed in these image forming apparatuses, most of the developing units have adopted a configuration including a plurality of toner containers arranged therein, wherein the toner supplied from each toner container is not directly fed to the developing hopper but is once collected in a toner feed device that functions as a "relay box", then is fed into the developing hopper as the toner concentration therein becomes lower, in order to keep the toner concentration in the developing hopper constant and avoid indication of "toner empty" from occurring even when a large volume of printing has been performed (see patent document 1: Japanese Patent Application Laid-open Hei 03-220577).

There is an apparatus configuration with the above toner supply method, which employs a technique whereby a plurality of toner containers are arranged at locations away from the developing unit and print processor and the apparatus can continue its print processing step even if one of the toner containers which has been detected as being empty is being replaced.

According to this toner supply method, even if the content of the toner container is used up, the toner in the relay box can be supplied so as to permit continuation of the printing job in progress. However, this method entails the problem that it is troublesome for the user to replace the toner container and that there is a need to devise a countermeasure to prevent toner from scattering inside the machine.

SUMMARY OF THE TECHNOLOGY

The present technology has been devised in view of the above conventional problem, it is therefore an object of the present technology to provide a control method of driving toner containers and an image forming apparatus using this drive control method, in which work performance is enhanced by improving the visibility of toner containers to be replaced and replacement of the toner containers are facilitated without undergoing any toner scattering inside the apparatus.

The control method of driving toner containers for solving the above problems and the image forming apparatus using this method are configured as follows.

A toner container drive control method according to the first aspect of the present technology is a control method of driving toner containers for use in an apparatus including a plurality of toner containers each filled with toner and detachably mounted thereinto from a toner container covering structure; and a toner supply device for supplying toner to a developing unit while rotating the plurality of toner containers, comprising the steps of: detecting a first toner container whose toner has run out, among the plurality of toner containers; opening the toner container covering structure when the first toner container has been detected; stopping the rotational motion of the first toner container when the first toner container has been detected; and, continuing the rotational motion of a second toner container or containers other than the first toner container when the first toner container has been detected.

A toner container drive control method according to the second aspect of the present technology, in addition to the configuration described in the above first aspect, further comprises: continuing a printing operation including a developing process by the developing unit, under the condition in which the first toner container is being stopped from rotating.

A toner container drive control method according to the third aspect of the present technology, in addition to the configuration described in the above first aspect, further comprises: continuing a printing operation including a developing process by the developing unit when the first toner container is removed from and mounted to the apparatus through the toner container covering structure, under the condition in which the first toner container is being stopped from rotating.

An image forming apparatus according to the fourth aspect of the present technology, includes: a developing unit; a plurality of toner containers each filled with toner; a remaining quantity detector for detecting the amount of the toner left in each toner container; a toner feed portion to which the toner container is mounted, for delivering the toner discharged from the toner container to the developing unit; and a toner container covering structure, and is characterized in that the plurality of toner containers can be detachably mounted to the toner feed portion through the toner container covering structure from the outside of the apparatus, the plurality of toner containers feed the toner to the developing unit while they are being rotated, when a first toner container whose toner has run out is detected by the remaining quantity detector, the toner container covering structure is made open and the rotational motion of the first toner container is stopped while the rotational motion of a second toner container or containers other than the first toner container is continued.

The image forming apparatus is further characterized in that a printing operation including a developing process by the developing unit is continued under the condition in which the first toner container is being stopped from rotating.

The image forming apparatus is further characterized in that a printing operation including a developing process by the developing unit is continued when the first toner container is removed from and mounted to the apparatus through the toner container covering structure, under the condition in which the first toner container is being stopped from being rotated.

According to the first aspect, it is possible to easily know the toner container that is empty of toner and hence needs to be replaced, by checking the open or closed state of the toner container covering structure. Further, since the toner bottle empty of toner is stopped from rotating, it is possible to replace the toner container easily without undergoing any toner scatter inside the apparatus.

That is, it is possible to improve the toner container to be replaced in recognizability, and it is also possible to improve the work efficiency of the replacement work of the toner container by facilitating replacement of the toner container without undergoing any toner scatter inside the apparatus.

According to the second aspect, in addition to the effect achieved by the first aspect, since if the toner in the toner container ran out, the toner reserved in the developing unit can be used, it is possible to operate the apparatus highly efficiently without the need of stopping the printing operation immediately.

Illustratively, it is possible to lengthen the operating time of the apparatus by making such an arrangement that toner can be supplied from the toner container to the developing unit by way of a relay box (toner feed device) or the like.

According to the third aspect, in addition to the effect achieved by the first aspect, when a toner container having no toner left therein is replaced, the toner container can be replaced without stopping the printing operation in progress. Accordingly, it is possible to operate the apparatus highly efficiently.

According to the fourth aspect, it is possible to provide an image forming apparatus which is improved in the recognizability of the toner container to be replaced and also in work efficiency.

BRIEF DESCRIPTION OF THE DRAWINGS

FIG. 29 is a flow chart showing a toner supply operation based on a toner container drive control method for the toner supply device; and, FIG. 30 is an illustrative view showing an overall configuration (a configuration viewed from the control side) of a copier.

DESCRIPTION OF THE PREFERRED EMBODIMENTS

The best mode for carrying out the present technology will be described with reference to the drawings.

Figure 1:
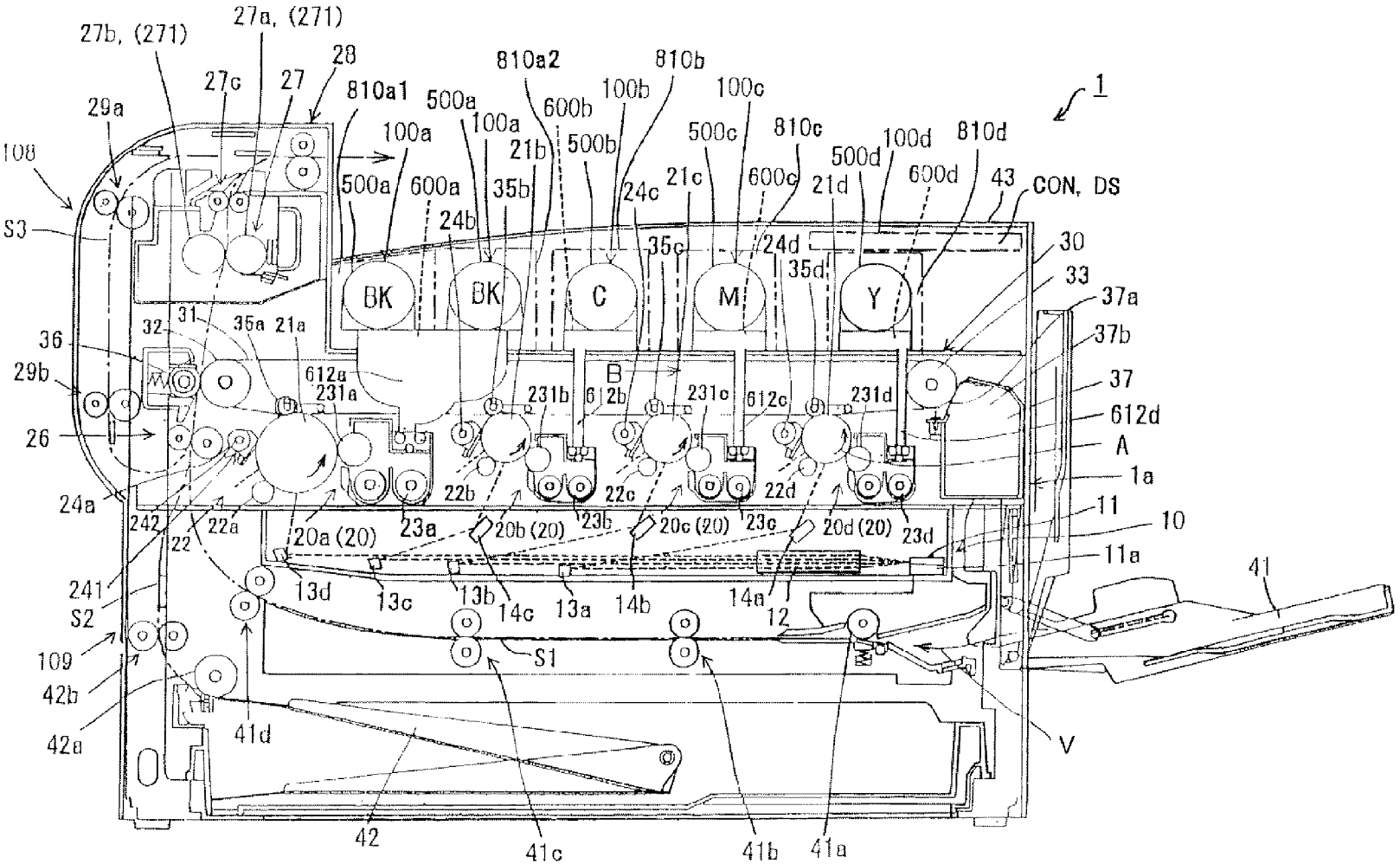
FIG. 1 is an illustrative view showing an overall configuration (a configuration viewed from the side opposite to the control side) of an image forming apparatus using a toner container drive control method for a toner supply device.

FIG. 1 is an example of a mode for carrying out the present technology, and is an illustrative view showing an overall configuration (a configuration viewed from the side opposite to the control side) of an image forming apparatus employing a toner container drive control method for a toner supply device.

Figure 3:
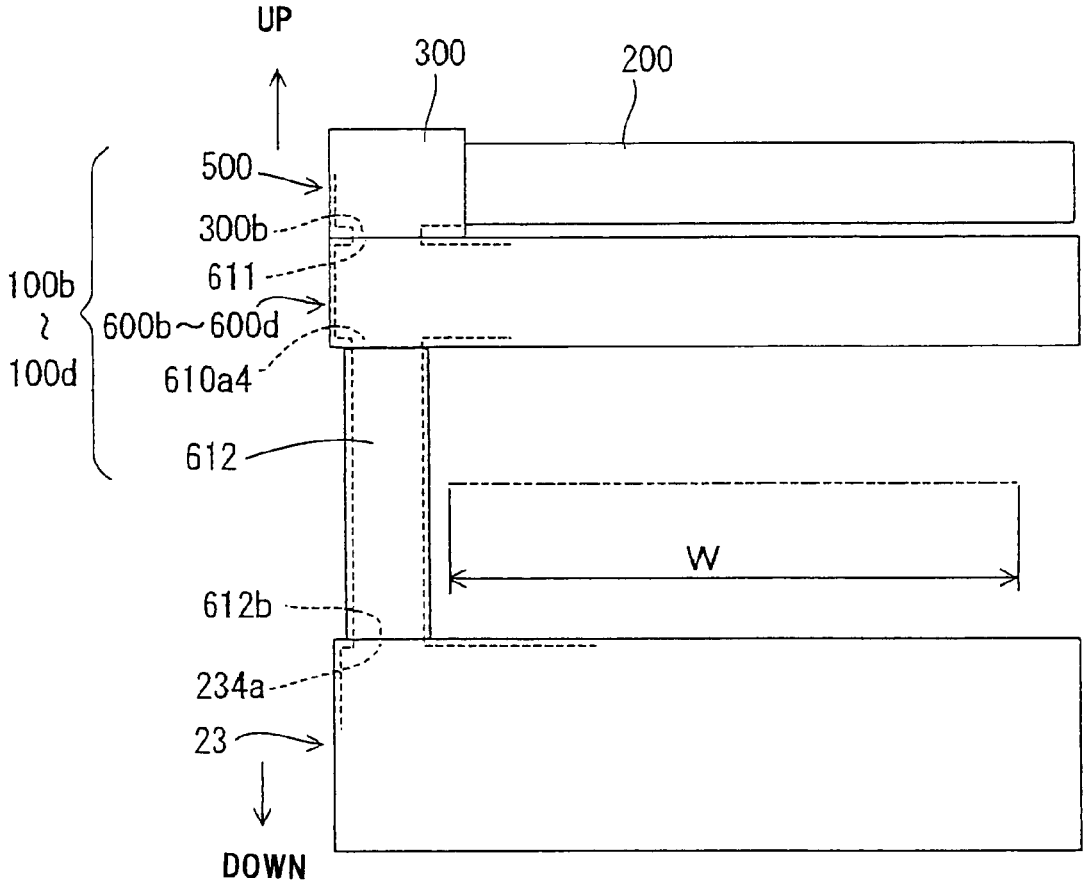
FIG. 3 is an overall front view showing the developing unit and toner supply device.

As shown in FIG. 1, the present embodiment is applied to an image forming apparatus 1 in which developer images formed on photoreceptor drums 21 (21*a*, 21*b*, 21*c* and 21*d*) with developers (toners) that are supplied from developing rollers 231 (231*a*, 231*b*, 231*c* and 231*d*) in accordance with image data are transferred to a recording sheet by a transfer process. This image forming apparatus 1 includes toner supply devices 100 (100*a*, 100*b*, 100*c* and 100*d*), each having a toner bottle (toner container) 200 (200*a*, 200*b*, 200*c* or 200*d*: FIG. 3) filled with toner and a toner supply assembly mounting mechanism (toner feed device) 600 (600*a*, 600*b*, 600*c* or 600*d*) that has toner bottle 200 mounted thereon and feeds the toner discharged from the toner bottle 200 to a corresponding developing unit 23 (23*a*, 23*b*, 23*c* or 23*d*) and each supplying toner to the developing unit 23 in accordance with the amount of toner consumed at the printing process in developing unit 23, to thereby perform image output as toner is automatically supplied to developing units 23.

As shown in FIG. 1, image forming apparatus 1 according to the present embodiment includes: a plurality of process printing units (image forming means) 20 (20*a*, 20*b*, 20*c* and 20*d*) each having a photoreceptor drum 21 (21*a*, 21*b*, 21*c* or 21*d*) on which a developer image (which will be referred to as "toner image" hereinbelow) is formed with a developer (which will be referred to as "toner" hereinbelow) corresponding to the color of color-separated image information and a developing unit 23 (23*a*, 23*b*, 23*c* or 23*d*) for supplying the toner to the photoreceptor drum 21 surface; an exposure unit (light scanning device) 10 for creating electrostatic latent images on photoreceptor drums 21 of individual colors by illumination of laser beams in accordance with image information; a transfer belt unit 30 having an endless transfer belt 31 for conveying toner images; and a fixing unit 27 for thermally fixing the toner images transferred to recording paper, by means of a heat roller 27*a* and a pressing roller 27*b*.

To begin with, the overall configuration of image forming apparatus 1 will be described.

As shown in FIG. 1, image forming apparatus 1 according to the present embodiment is a so-called digital color printer which is adapted to output a color image by separating image information into colors and forming images of individual colors, is mainly composed of an image forming portion 108 and a paper feed portion 109, and forms multi-color images or monochrome images on recording paper in accordance with a print job sent from an information processor (not illustrated) such as a personal computer etc., externally connected.

Image forming portion 108 forms multi-color images based on electrophotography using yellow (Y), magenta (M), cyan (C) and black (BK) colors. This image forming portion is mainly composed of exposure unit 10, process printing units 20, fixing unit 27, a transfer belt unit 30 having transfer belt 31 as a transfer means, transfer roller 36 and a transfer belt cleaning unit 37.

In the overall arrangement of image forming portion 108, fixing unit 27 is disposed in the upper part at one end side of a housing 1*a* of image forming apparatus 1, transfer belt unit 30 is extended under the fixing unit 27 from one end side to the other end side of housing 1*a*, process printing units 20 are disposed under the transfer belt unit 30, and exposure unit 10 is disposed under the process printing units 20.

Further, transfer belt cleaning unit 37 is arranged on the other end side of transfer belt unit 30. Also, a paper output tray 43 is arranged contiguous to fixing unit 27, over image forming portion 108. Paper feed portion 109 is arranged under the image forming portion 108.

In the present embodiment, as process printing units 20, four process printing units 20*a*, 20*b*, 20*c* and 20*d*, corresponding to individual colors, i.e., black (BK), cyan (C), magenta (M) and yellow (Y) are arranged sequentially along transfer belt 31.

These process printing units 20 (20*a*, 20*b*, 20*c* and 20*d*) are arranged in parallel to each other, in the approximately horizontal direction (in the left-to-right direction in the drawing) in housing 1*a*, and include respective photoreceptor drums 21 (21*a*, 21*b*, 21*c* and 21*d*) as the image support for each individual associated color, respective chargers (charging means) 22 (22*a*, 22*b*, 22*c* and 22*d*) for charging the photoreceptor drums 21, respective developing units (developing means) 23 (23*a*, 23*b*, 23*c* and 23*d*) and respective cleaner units 24 (24*a*, 24*b*, 24*c* and 24*d*) and other components.

Here, the symbols a, b, c, and d added to the constituents for individual colors show correspondence to black (BK), cyan (C), magenta (M) and yellow (Y), respectively. In the description hereinbelow, however, the constituents provided for each color are generally referred to as photoreceptor drum 21, charger 22, developing unit 23, and cleaner unit 24, except in the case where the constituents corresponding to a specific color need to be specified and described.

Photoreceptor drum 21 is arranged so that part of its outer peripheral surface comes into contact with the surface of transfer belt 31 while charger 22 as an electric field generator, developing unit 23 and cleaner unit 24 are arranged along, and close to, the outer peripheral surface of the drum.

As charger 22, a corona-wire charger is used and arranged, at a position on the approximately opposite side across photoreceptor drum 21, from transfer belt unit 30 and close to the outer peripheral surface of photoreceptor drum 21. Though in the present embodiment a corona-wire charger is used as charger 22, any type of charger can be used without limitation, in place of the corona-wire charger, such as a fur brush type charger, magnetic brush type charger, roller-type charger, saw-toothed type charger, ion-generation charging device etc., as long as it can provide the desired charge performance to the photoreceptor drum.

Developing units 23*a*, 23*b*, 23*c* and 23*d* hold associated toners of black (BK), cyan (C), magenta (M) and yellow (Y) colors, each developing unit 23 being arranged on the downstream side of charger 22 with respect to the rotational direction of the photoreceptor drum (in the direction of arrow A in the drawing).

In developing units 23*a*, 23*b*, 23*c* and 23*d*, in order to deal with high-speed and large-volume printing, toner supply devices 100*a*, 100*b*, 100*c* and 100*d* equipped with five toner supply assemblies 500*a*, 500*b*, 500*c* and 500*d* for supplying developers to respective developing units 23*a*, 23*b*, 23*c* and 23*d* are provided. Developing rollers 231*a*, 231*b*, 231*c* and 231*d* are arranged opposing respective photoreceptor drums

21*a*, 21*b*, 21*c* and 21*d*, so as to supply the associated colors of toners to the electrostatic latent images formed on the outer peripheral surfaces of photoreceptor drums 21*a*, 21*b*, 21*c* and 21*d*, respectively to visualize them.

As the toner to be supplied, toners of black (BK), cyan (C), magenta (M) and yellow (Y) colors are stored in toner supply assemblies 500*a*, 500*b*, 500*c* and 500*d*, respectively.

Here, two toner supply assemblies 500*a* for black (BK) toner are arranged side by side in order to support large-volume printing, taking into account the practice that monochrome printing is usually used most frequently.

Each toner supply assembly 500 is arranged at a position approximately directly above the developing unit 23 for performing development with the corresponding toner, and is connected to the corresponding developing unit 23 by means of a toner supply passage part 612 (612*a*, 612*b*, 612*c* or 612*d*).

Here, supply passage part 612*a* and toner supply assembly mounting mechanism 600*a* for supplying the black (BK) toner is constructed so that the toner from two toner supply devices 100*a* and 100*a* can be put together and supplied to developing unit 23*a*.

Cleaner unit 24 is arranged on the upstream side of charger 22 with respect to the rotational direction of the photoreceptor drum. Cleaner unit 24 has a cleaning blade 241 and is configured so that the cleaning blade 241 is positioned in abutment with the outer peripheral surface of photoreceptor drum 21 so as to scrape and collect the leftover toner off the photoreceptor drum 21. A reference numeral 242 in the drawing designates a conveying screw for conveying the collected toner.

In the present embodiment, cleaning blade 241 is used but the cleaning unit is not limited to this configuration. One or more cleaning blades may be used or a fur-brush or magnetic brush may be used alone. Alternatively, a fur-brush or magnetic brush may be used in combination with a cleaning blade. That is, any configuration may be used as long as it can scrape and collect the leftover toner off the photoreceptor drum 21. Exposure unit 10 is mainly composed of a box-shaped housing, a laser scanning unit (LSU) 11 having a laser illuminator 11*a* incorporated therein, a polygon mirror 12 and reflection mirrors 13*a*, 13*b*, 13*c*, 13*d*, 14*a*, 14 band 14*c* etc. for reflecting the laser beams for associated colors.

The laser beam emitted from laser illuminator 11*a* of laser scanning unit 11 is separated into color components by polygon mirror 12 and an unillustrated f-θ lens, then the separated components of light are reflected by reflection mirrors 13*a* to 13*d* and 14*a* to 14*c* to illuminate the respective photoreceptor drums 21*a*, 21*b*, 21*c* and 21*d* of individual colors.

Here, concerning laser scanning unit 11, a writing head made up of an array of light emitting devices such as EL (electro luminescence), LED (light emitting diode) and others, may be used instead of the laser illuminator. Also, a light source in combination with a liquid crystal shutter may be used. That is, any configuration can be used as long as it can create an electrostatic latent image on the photoreceptor drum 21 surface.

As shown in FIG. 1, transfer belt unit 30 is essentially composed of transfer belt 31, a transfer belt drive roller 32, a transfer belt driven roller 33 and intermediate transfer rollers 35*a*, 35*b*, 35*c* and 35*d*.

In the following description, any of intermediate transfer rollers 35*a*, 35*b*, 35*c* and 35*d* will be referred to as intermediate transfer roller 35 when general mention is made.

Transfer belt 31 is formed of an endless film of about 75 μm to 120 μm thick. Transfer belt 31 is essentially made from polyimide, polycarbonate, thermoplastic elastomer alloy or the like.

Also, transfer belt 31 is tensioned by transfer belt drive roller 32, transfer belt driven roller 33 and intermediate transfer rollers 35 so that its surface comes into contact with the outer peripheral surfaces of photoreceptor drums 21, and is adapted to move in the auxiliary scan direction (in the direction of arrow B in the drawing) by the driving force of the transfer belt drive roller 32.

Transfer belt drive roller 32 is disposed at one end side of housing 1*a* and drives the transfer belt 31 by applying a driving force to transfer belt 31 whilst nipping and pressing the transfer belt 31 and a recording sheet together between itself and transfer roller 36 to convey the recording sheet.

Transfer belt driven roller 33 is disposed on the other end side of housing 1*a*, so as to suspend and tension the transfer belt 31 approximately horizontally from the fixing unit 27 side to the other end side of housing 1*a*, in cooperation with transfer belt drive roller 32. However, if the dimension in the width direction of image forming apparatus 1 in FIG. 1 needs to be smaller, that is, if the foot print is made smaller with respect to the width direction in order to achieve space-saving, the position of transfer belt drive roller 32 may be displaced so that transfer belt 31 is inclined in either way from the fixing unit 27 side to the other of housing 1*a* while the photoreceptors, developing units, laser illuminator, fixing unit and other components may be rearranged and resized as appropriate in association with that change in layout.

Intermediate transfer rollers 35 may be arranged in the interior space of transfer belt 31 wound between transfer belt drive roller 32 and transfer belt driven roller 33 and positioned with their axes displaced relative to corresponding photoreceptor drums 21, in the lateral direction in the drawing, to the downstream side with respect to the moving direction of transfer belt 31, so as to press the inner surface of transfer belt 31 and bring its outer peripheral surface into contact with part of the outer peripheral surface of each photoreceptor drum 21, forming a predetermined amount of nip.

Further, each intermediate transfer roller 35 is formed of a metal (e.g., stainless steel) shaft having a diameter of 8 to 10 mm and a conductive elastic material such as EPDM, foamed urethane etc., coated on the outer peripheral surface of the metal shaft. However, the configuration should not be limited to use of these elastic materials.

The thus formed intermediate transfer roller 35 is applied with a high-voltage transfer bias for transferring the toner image formed on photoreceptor drum 21 to transfer belt 31, i.e., a high voltage of a polarity (+) opposite to the polarity (−) of the electrostatic charge on the toner, so as to apply a uniform high voltage from the elastic material to transfer belt 31.

The visualized toner images (electrostatic images) formed on the photoreceptor drums 21 correspondingly to respective colors are transferred one over another on transfer belt 31, reproducing the image information that has been input to the apparatus. The thus formed laminated image information is transferred to the recording sheet by transfer roller 36 that is disposed at its contact point with transfer belt 31.

Transfer roller 36 as a constituent of the transfer means is a component for transferring the toner image transferred to transfer belt 31 to recording paper, and is arranged opposing transfer belt drive roller 32 at approximately the same level and in parallel thereto and pressing against the transfer belt 31 that is wound on the transfer belt driver roller 32, forming a predetermined nip therewith while being applied with a high voltage of a polarity (+) opposite to the polarity (−) of the static charge on the toner, for transferring the multi-color toner image formed on the transfer belt 31 to the recording paper.

In order to produce a constant nip between transfer belt 31 and transfer roller 36, either transfer belt drive roller 32 or transfer roller 36 is formed of a hard material such as metal or the like while the other roller is formed of a soft material such as elastic rubber, foamed resin, etc.

A registration roller 26 is provided under transfer belt drive roller 32 and transfer roller 36. This registration roller 26 is configured so as to deliver the recording sheet that is fed from paper feed portion 109 toward the transfer roller 36 side by aligning the front end of the sheet with the leading end of the toner image on transfer belt 31.

Since the toner adhering to transfer belt 31 as a result of contact of the belt with photoreceptor drums 21, or the toner which has not been transferred to the recording sheet by transfer roller 36 and remains on transfer belt 31, would cause color contamination of toners at the next operation, transfer belt cleaning unit 37 is adapted to remove and collect such toner.

Transfer belt cleaning unit 37 includes: a cleaning blade 37*a*, located near transfer belt driven roller 33 and arranged so as to abut (come into sliding contact with) transfer belt 31; and a box-like toner collector 37*b* for temporarily holding the waste toner, left over on and scraped from transfer belt 31 by the cleaning blade 37*a*, to thereby scrape and collect the leftover toner off the transfer belt 31 surface.

Also, transfer belt cleaning unit 37 is arranged near process printing unit 20*d*, on the upstream side of the process printing unit 20*d* with respect to the moving direction of transfer belt 31. Further, transfer belt 31 is supported from its interior side by transfer belt driven roller 33, at the portion where cleaning blade 37*a* comes into contact with the outer surface of transfer belt 31.

Fixing unit 27 includes: as shown in FIG. 1, a pair of fixing rollers 271 consisting of a heat roller 27*a* and pressing roller 27*b*; and a conveying roller 27*c* above the fixing rollers 271. A recording sheet is input from below fixing rollers 271 and output upward towards conveying roller 27*c*.

Above fixing unit 27 a paper discharge roller 28 is arranged so that the recording sheet conveyed from conveying roller 27*c* is discharged by the paper discharge roller 28 onto paper output tray 43.

Referring to the fixing of a toner image by fixing unit 27, a heating device (not shown) such as a heater lamp or the like, provided inside or close to heat roller 27*a* is controlled based on the detected result from a temperature detector (not shown) so as to keep heat roller 27*a* at a predetermined temperature (fixing temperature) while the recording sheet with a toner image transferred thereon is heated and pressed between heat roller 27*a* and pressing roller 27*b* as it is being conveyed and rolled thereby, so that the toner image is thermally fused onto the recording sheet.

Arranged adjacent to fixing unit 27 from the rear side of fixing unit 27 downward to the vicinity of paper feed portion 109 is a duplex printing paper path S3 for double-sided printing. Conveying rollers 29*a* and 29*b*, arranged at the top and bottom and along the duplex printing paper path S3, is adapted to convey the recording paper with its face turned out and lead it toward transfer roller 36 once again.

Specifically, conveying roller 29*a* is disposed at the rear of fixing unit 27 and conveying roller 29*b* is arranged below conveying roller 29*a* with respect to the vertical direction and at approximately the same level as registration roller 26.

In the present embodiment, heat roller 27 a using a heating means made up of a heater lamp etc., is used with pressing roller 27*b*, but an induction heating type heating device may be used alone or in combination. Further, it is not necessary to use a roller as a means for applying pressure. That is, any appropriate method can be used as long as it can uniformly fix the toner image to the recording paper with heat without causing any image disturbance.

Paper feed portion 109 includes a manual feed tray 41 and paper feed cassette 42 for holding recording paper to be used for image forming, and is adapted to deliver recording paper, sheet by sheet, from manual feed tray 41 or paper feed cassette 42 to image forming portion 108.

As shown in FIG. 1, manual feed tray 41 is arranged at one side end (on the right side in the drawing) of housing 1*a* of image forming apparatus 1 so that it can be unfolded outside when used and folded up to the one end side when unused. This tray delivers recording paper, sheet by sheet, into the housing 1*a* of image forming apparatus 1 when the user places a few recording sheets (necessary number of sheets) of a desired type.

Arranged inside housing 1*a* of image forming apparatus 1 on the downstream side with respect to the manual feed tray 41's paper feed direction of recording paper (the direction of arrow V in the drawing) is a pickup roller 41*a* at the side of exposure unit 10. A conveying roller 41*b* is also disposed at approximately the same level further downstream with respect to the paper feed direction.

Pickup roller 41*a* touches one edge part of the surface of the recording sheet that is fed from manual feed tray 41 and reliably conveys the paper, sheet by sheet, by the function roller's frictional resistance.

The aforementioned pickup roller 41*a* and conveying rollers 41*b*, 41*c* and 41*d* constitute a recording paper conveying path S1.

On the other hand, paper feed cassette 42 is arranged under the image forming portion 108 and exposure unit 10 in housing 1*a*, so as to accommodate a large amount of recording sheets of a size specified by the specification of the apparatus or of a size that is determined beforehand by the user.

Arranged above one end side (the left-hand side in the drawing) of paper feed cassette 42 is a pickup roller 42*a*. A conveying roller 42*b* is also provided on the downstream side of the pickup roller 42*a* with respect to the pickup roller 42*a*'s feed direction of recording paper.

Pickup roller 42*a* touches one edge part of the surface of the topmost sheet of the recording sheets set on the paper feed cassette 42 in response to a printout request and reliably picks up and feeds the paper, sheet by sheet, by the function of roller's frictional resistance.

Conveying roller 42*b* conveys the recording sheet delivered from pickup roller 42*a* upward along a recording sheet feed path S2 formed on one end side inside housing 1*a* to image forming portion 108.

Next, image output by image forming apparatus 1 of the present embodiment will be described.

Image forming apparatus 1 is constructed so as to transfer the toner images formed on photoreceptor drums 21 to a recording sheet fed from paper feed portion 109 by a so-called intermediate transfer process (offset process) via transfer belt 31.

First, charger 22 uniformly electrifies the outer peripheral surface of photoreceptor drum 21 at a predetermined voltage. Each electrified photoreceptor drum 21 is irradiated with a laser beam from exposure unit 10, so that an electrostatic latent image for each color is formed on the photoreceptor drum 21 for the color.

Next, toners are supplied from developing units 23 (23*a*, 23*b*, 23*c* and 23*d*) to the outer peripheral surfaces of photoreceptor drums 21 (21*a*, 21*b*, 21*c* and 21*d*) so that the static latent images formed on the outer peripheral surfaces of photoreceptor drums 21 are visualized with the toners so as to form toner images.

Then, the toner images formed on photoreceptor drums 21 are transferred to transfer belt 31.

Transfer of the toner image from photoreceptor drum 21 to transfer belt 31 is done by application of a high voltage from intermediate transfer roller 35 arranged in contact with the interior side of transfer belt 31.

As intermediate transfer roller 35 is applied with a high voltage of a polarity (+) opposite to that of the polarity (−) of the electrostatic charge on the toner, transfer belt 31 has a high potential uniformly applied by the intermediate transfer roller 35, presenting the opposite polarity (+). Thereby, the toner image bearing negative (−) charge on photoreceptor drum 21 is transferred to transfer belt 31 as photoreceptor drum 21 turns and comes into contact with transfer belt 31.

The toner images of colors formed on respective photoreceptor drums 21 are transferred to transfer belt 31, laid over, one over another, in the order of yellow (Y), magenta (M), cyan (C) and black (BK) as transfer belt 31 moves to come into contact with each of the rotating photoreceptor drums 21, forming a color toner image on transfer belt 31.

In this way, the toner images developed from static latent images on photoreceptor drums 21 for every color, are laminated on transfer belt 31 so that the image for printing is reproduced as a multi-color toner image on transfer belt 31.

Then, as transfer belt 31 moves and reaches the position where the recording sheet and the transfer belt 31 meet, the multi-color toner image having been transferred on transfer belt 31 is transferred from transfer belt 31 to recording sheet by the function of transfer roller 36.

Since the toner adhering to transfer belt 31 as a result of contact of the belt with photoreceptor drums 21, or the toner which has not been transferred to the recording sheet by the function of transfer roller 36 and remains on transfer belt 31, would cause color contamination of toners at the next operation, it is removed and collected by transfer belt cleaning unit 37.

Next, the operation of feeding recording sheets by paper feed portion 109 will be described.

When the recording paper placed on manual feed tray 41 is used, as shown in FIG. 1 the paper is taken in by pickup roller 41*a* from manual feed tray 41, sheet by sheet, at controlled timings in accordance with the instructions from a control panel (not shown), and fed into the machine.

The recording sheet thus taken into the machine is conveyed along recording paper feed path S1 by conveying roller 41*b* to image forming portion 108.

When the recording paper accommodated in paper feed cassettes 42 is used, the paper is separated and fed from paper feed cassette 42, sheet by sheet, by pickup roller 42*a* in accordance with a printout request and conveyed by conveying roller 42*b* along recording paper feed path S2 to image forming portion 108 located above.

The recording sheet conveyed from manual feed tray 41 or paper feed cassette 42 is delivered to the transfer roller 36 side, by registration roller 26, at such a timing as to bring the front end of the recording sheet in register with the leading end of the toner image on transfer belt 31, so that the toner image on transfer belt 31 is transferred to the recording sheet.

The recording sheet with the toner image transferred thereon is conveyed approximately vertically and reaches fixing unit 27, where the toner image is thermally fixed to the recording sheet by heat roller 27*a* and pressing roller 27*b*.

When one-sided printing is requested, the recording sheet having passed through fixing unit 27 is discharged by discharge roller 28 and placed facedown onto paper output tray 43.

In contrast, when double-sided printing is requested, the recording sheet is stopped and nipped at paper discharge roller 28, the paper discharge roller 28 is then rotated in reverse so that the recording sheet is guided to duplex printing paper path S3 and conveyed again to registration roller 26 by conveying rollers 29*a* and 29*b*.

By this movement, the printing face of the recording sheet is inverted and the direction of conveyance is reversed. Illustratively, the leading edge of the sheet at the first printing is directed to the trailing end when the underside is printed, or the trailing edge of the sheet at the first printing is directed to the leading end when the underside is printed.

After the toner image is transferred and thermally fixed to the underside of the recording sheet, the sheet is discharged onto paper output tray 43 by paper discharge roller 28.

Thus, the transfer operation to recording paper is performed.

Next, toner supply device 100 according to the present embodiment, mounted to the image forming apparatus 1 thus constructed as above and toner container drive method for the toner supply device will be described in detail with reference to the drawings.

To begin with, the configuration of developing unit 23 and toner supply device 100 according to the present embodiment will be described in detail with reference to the drawings.

Figure 2:
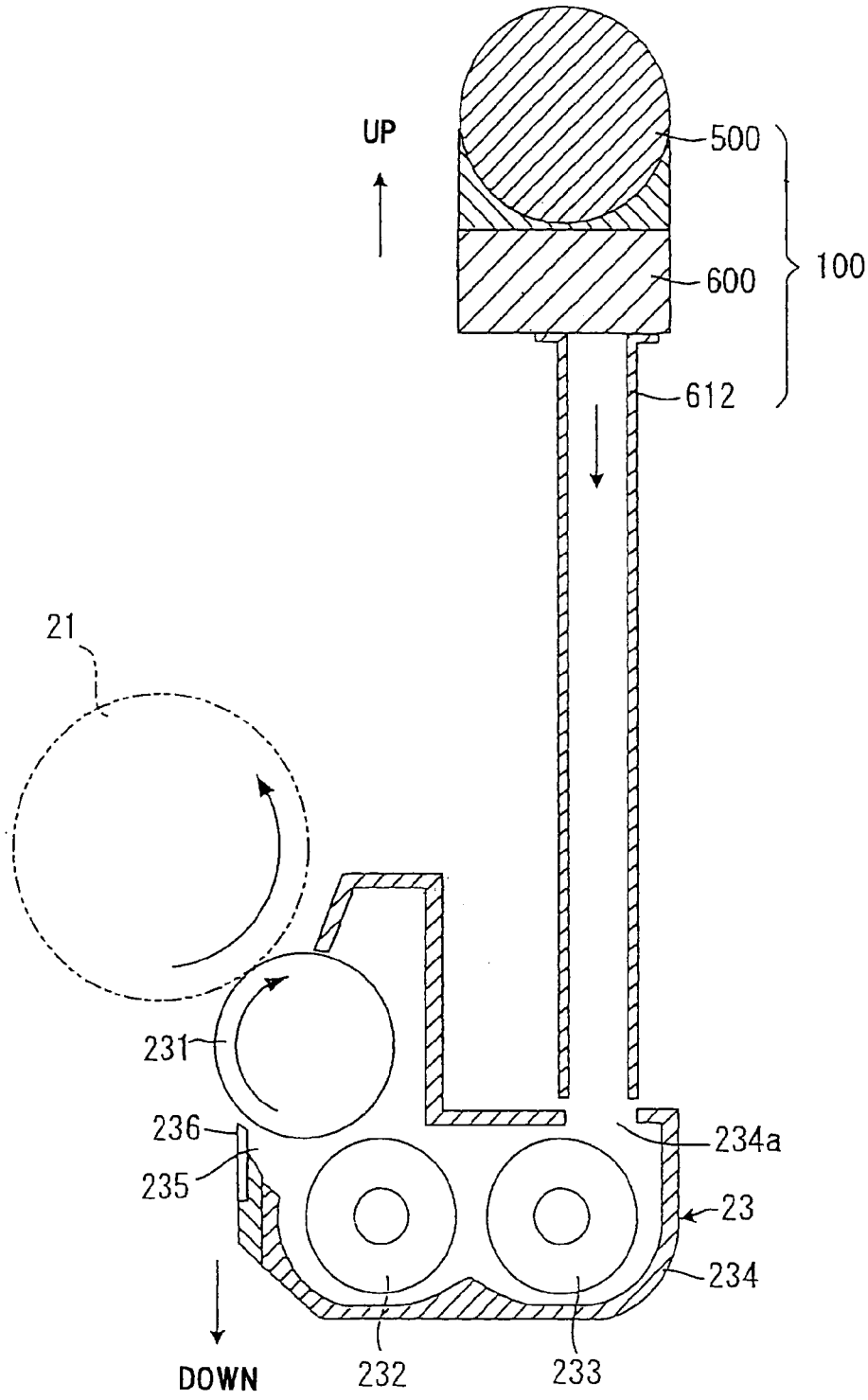
FIG. 2 is a schematic side sectional view showing a configuration of a developing unit and a toner supply device that constitute the image forming apparatus.
Figure 4:
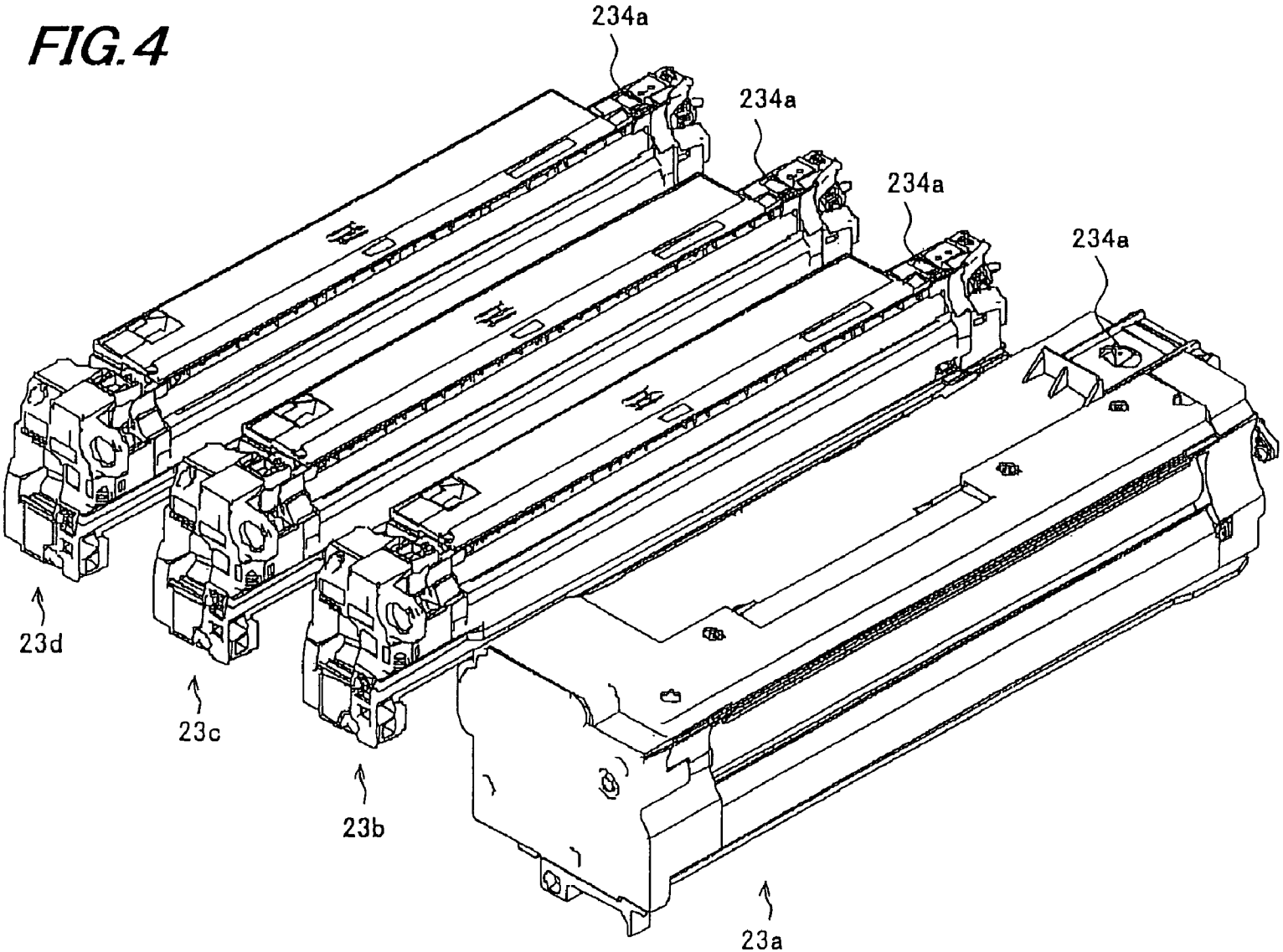
FIG. 4 is a perspective view showing the configuration of the developing unit.
Figure 5:
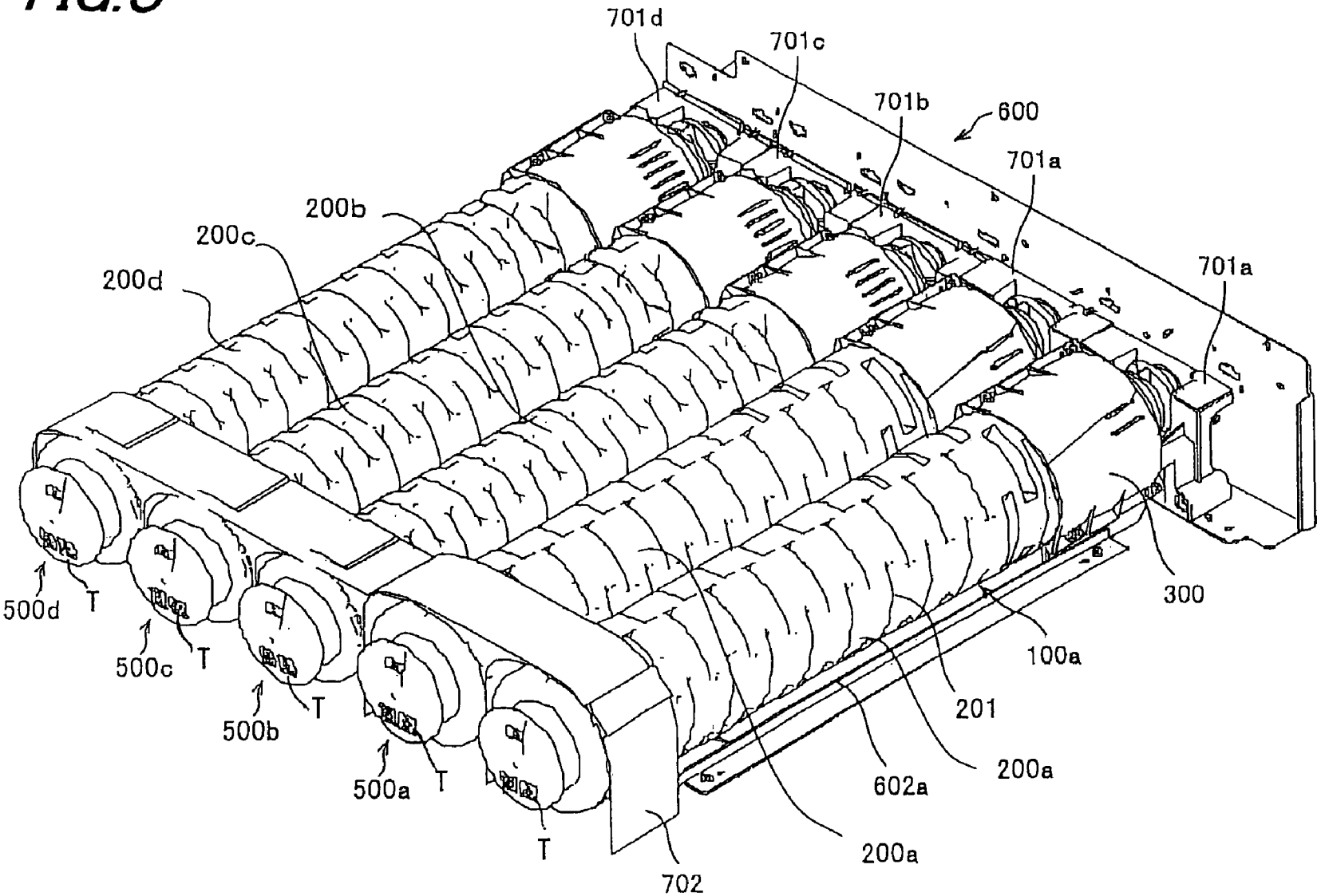
FIG. 5 is a perspective view showing a mounting example when toner supply assemblies are set in toner supply assembly mounting mechanisms that constitute the toner supply devices.
Figure 6:
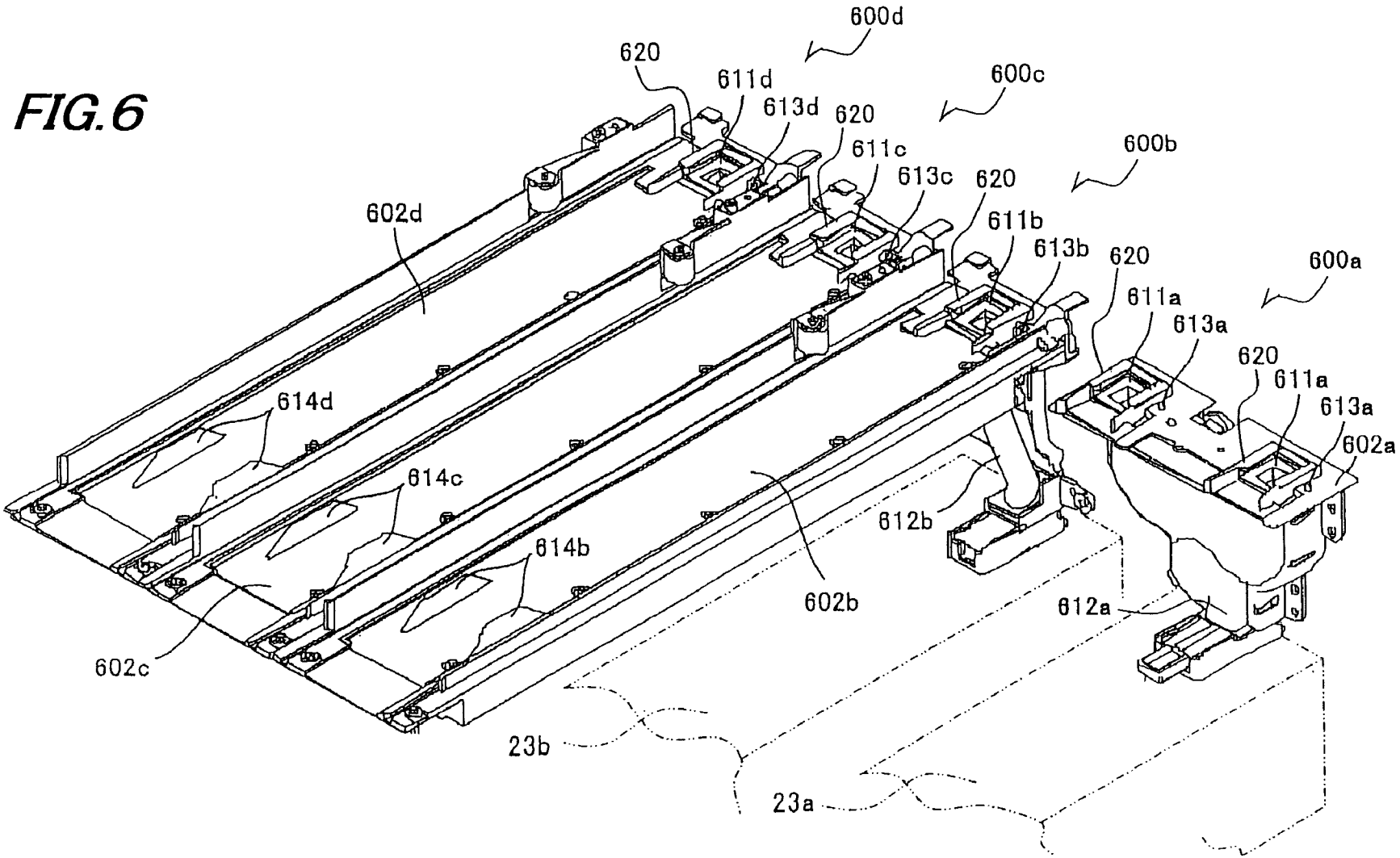
FIG. 6 is a perspective view showing the configuration of the toner supply assembly mounting mechanisms.

FIG. 2 is a schematic side sectional view showing a configuration of a developing unit and a toner supply device that constitute an image forming apparatus of the present embodiment; FIG. 3 is an overall front view showing the configuration of the developing unit and toner supply device; FIG. 4 is a perspective view showing the configuration of the developing unit mounted to the image forming apparatus according to the present embodiment; FIG. 5 is a perspective view showing a mounting example when toner supply assemblies are set in a toner supply assembly mounting mechanisms that constitute the toner supply devices according to the present embodiment; and FIG. 6 is a perspective view showing a configuration of the toner supply assembly mounting mechanisms.

As shown in FIGS. 2 and 3, in developing unit 23 for image forming apparatus 1 according to the present embodiment, a toner input port 234*a* for leading toner is formed as an opening at the top of a casing 234 that forms the exterior. The developing unit incorporates inside casing 234 a developing roller 231, a first toner conveying roller 232 and a second toner conveying roller 233, and is mounted to the image forming apparatus body with the developing roller 231 opposed, in abutment with, or close to, photoreceptor drum 21. The toner input port 234*a* of developing unit 23 is formed at a position further outside of the width W of the transfer belt, on the same side as a toner feed port 611 (611*a*, 611*b*, 611*c* or 611*d*) of a toner supply assembly mounting mechanism 600 (600*a*, 600*b*, 600*c* or 600*d*) is disposed.

First toner conveying roller 232 and second toner conveying roller 233 are disposed in the bottom of casing 234 in parallel with each other along the axis direction of developing roller 231 so as to mix the toner that is fed into casing 234 with the developer and convey the mixture to developing roller 231. Developing roller 231 is arranged over and above first toner conveying roller 232 so as to be exposed from an opening mouth 235.

Casing 234 has a box-shaped configuration elongated in the direction (the width direction of the transfer belt) perpendicular to the direction of transfer (the transfer belt's direction of movement) when it is mounted in the image forming apparatus body, and is formed with opening mouth 235 so that developing roller 231 therein opposes photoreceptor drum 21 when developing unit 23 is mounted to the image forming apparatus body.

Opening mouth 235 is made open long across the width of casing 234 along the axis direction of developing roller 231 so that at least developing 231 will be able to oppose and abut photoreceptor drum 21. Provided along the bottom edge of opening mount 235 in the drawing is a blade 236 that extends in the axis direction of developing roller 231. Blade 236 is positioned so as to create a predetermined clearance between the blade 236 edge and the developing roller 231 surface, whereby a predetermined amount of toner can be supplied to the developing roller 231 surface through this clearance.

Arranged over the thus constructed developing unit 23 is toner supply device 100 (FIGS. 2 and 3).

Referring next to the drawings, the configuration of toner supply device 100 and toner bottle 200 will be described.

Figure 7A:
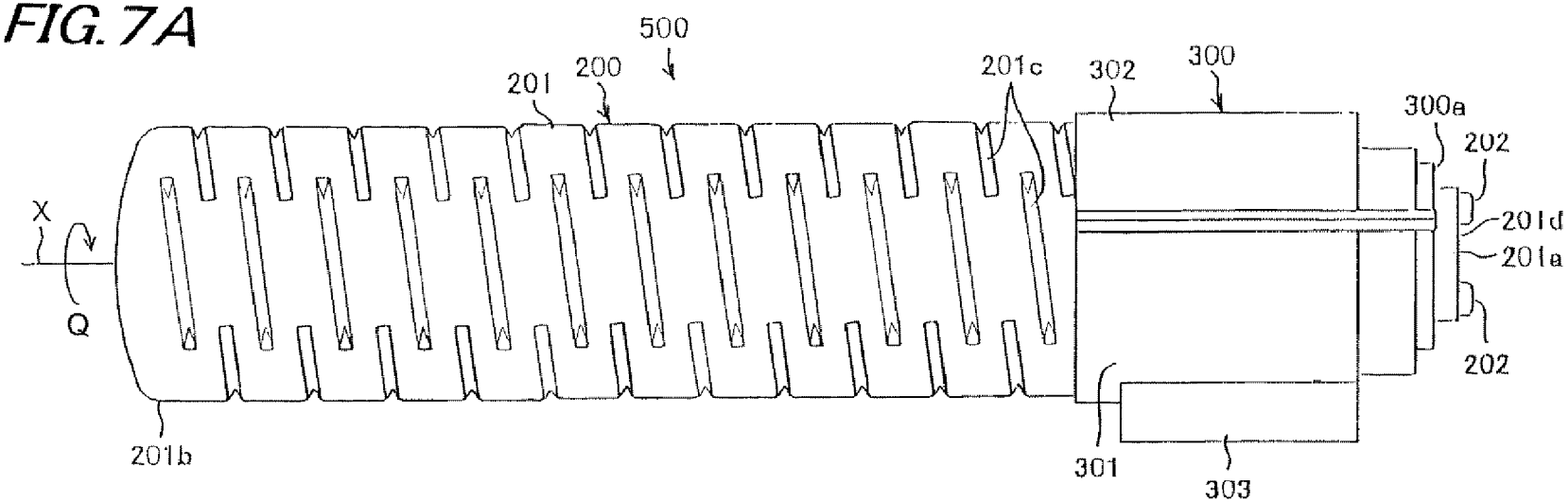
FIG. 7A is a side view showing a configuration of a toner supply assembly as a part of the toner supply device.
Figure 7B:
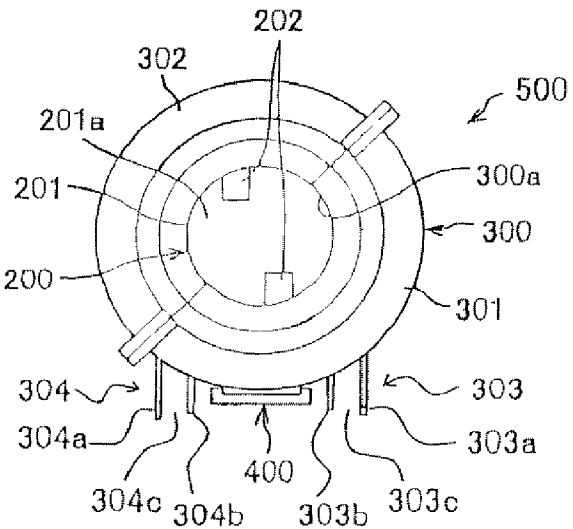
FIG. 7B is a front view, viewed from the end face side of the toner supply assembly from which toner is supplied.
Figure 8:
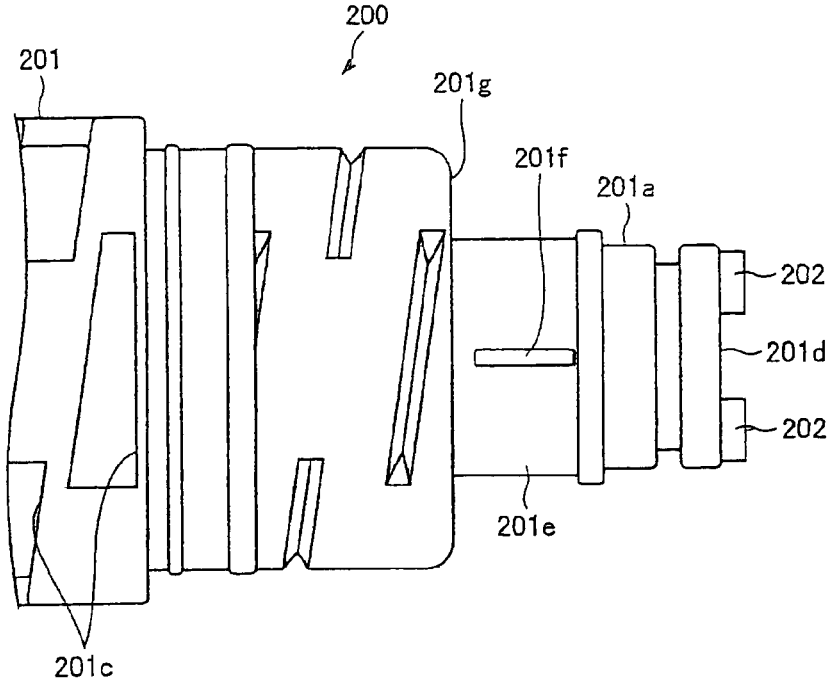
FIG. 8 is a side view of the front end part of a toner bottle as a part of the toner supply assembly.
Figure 9:
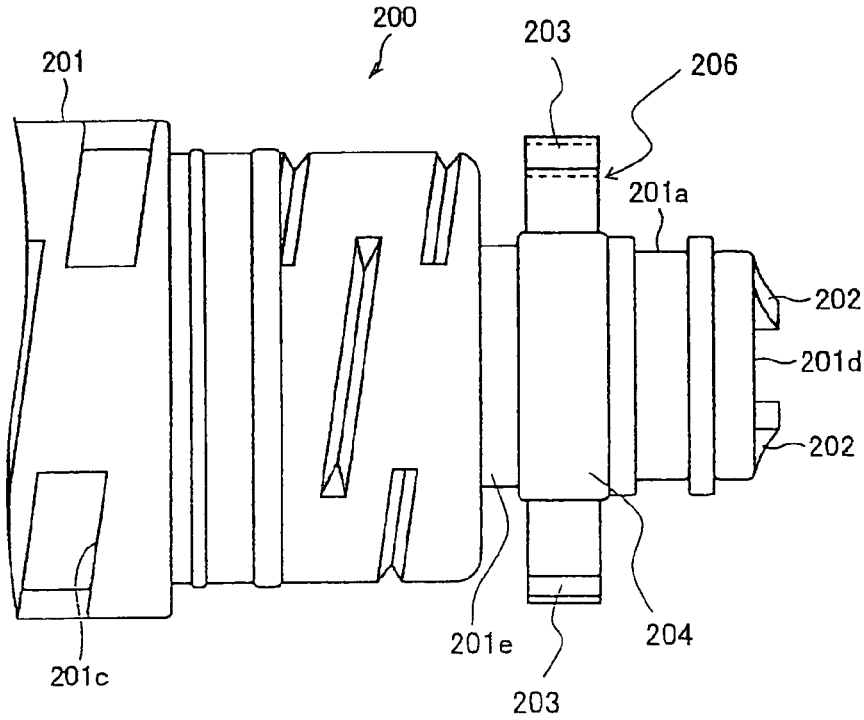
FIG. 9 is a side view showing a configuration when scrapers for toner conveyance are fitted to the front end part of the toner bottle.
Figure 10:
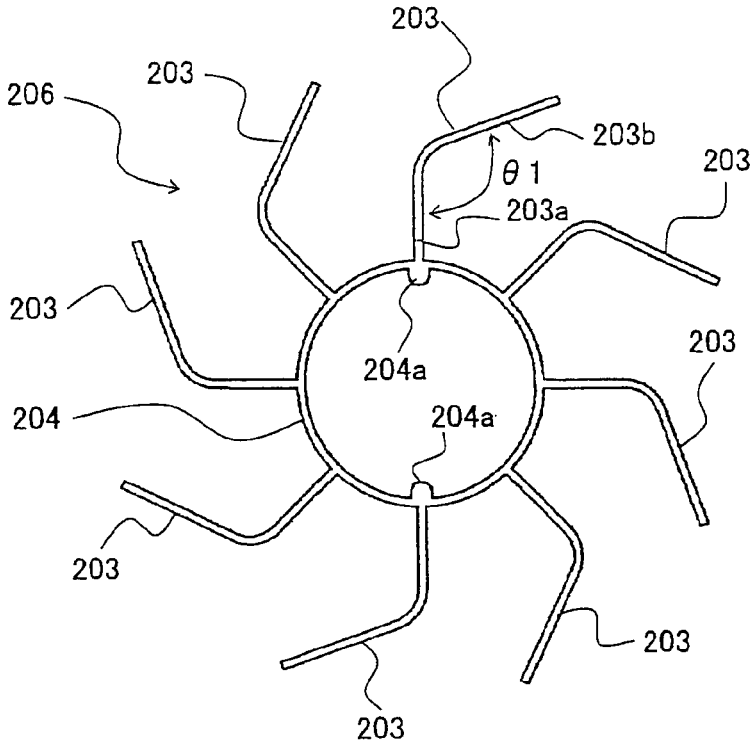
FIG. 10 is an illustrative view showing one example of the scrapers.
Figure 11:
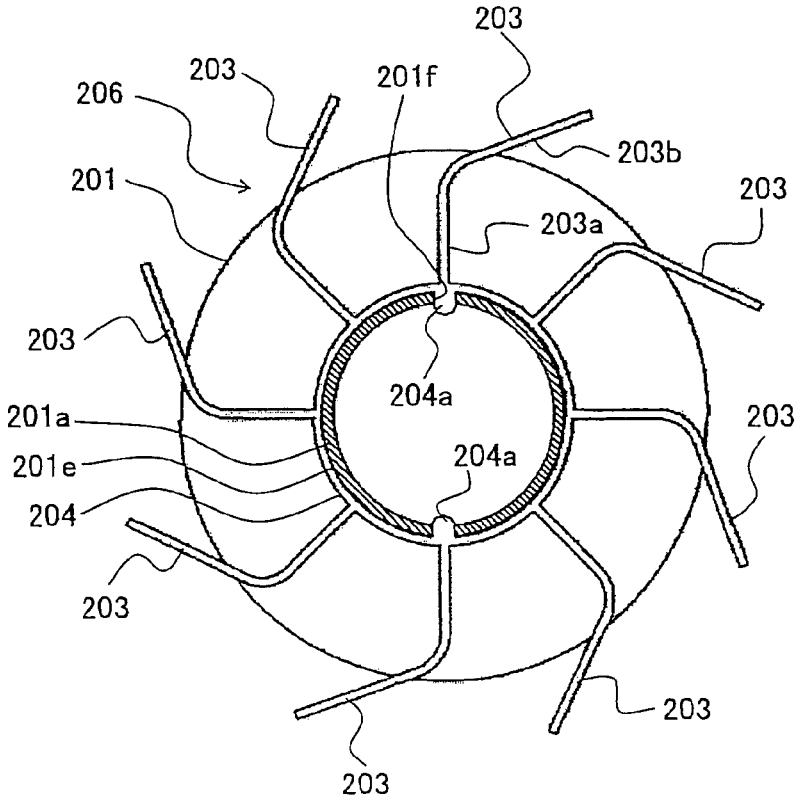
FIG. 11 is an illustrative view schematically showing a case where the scrapers are attached to a toner bottle.
Figure 12:
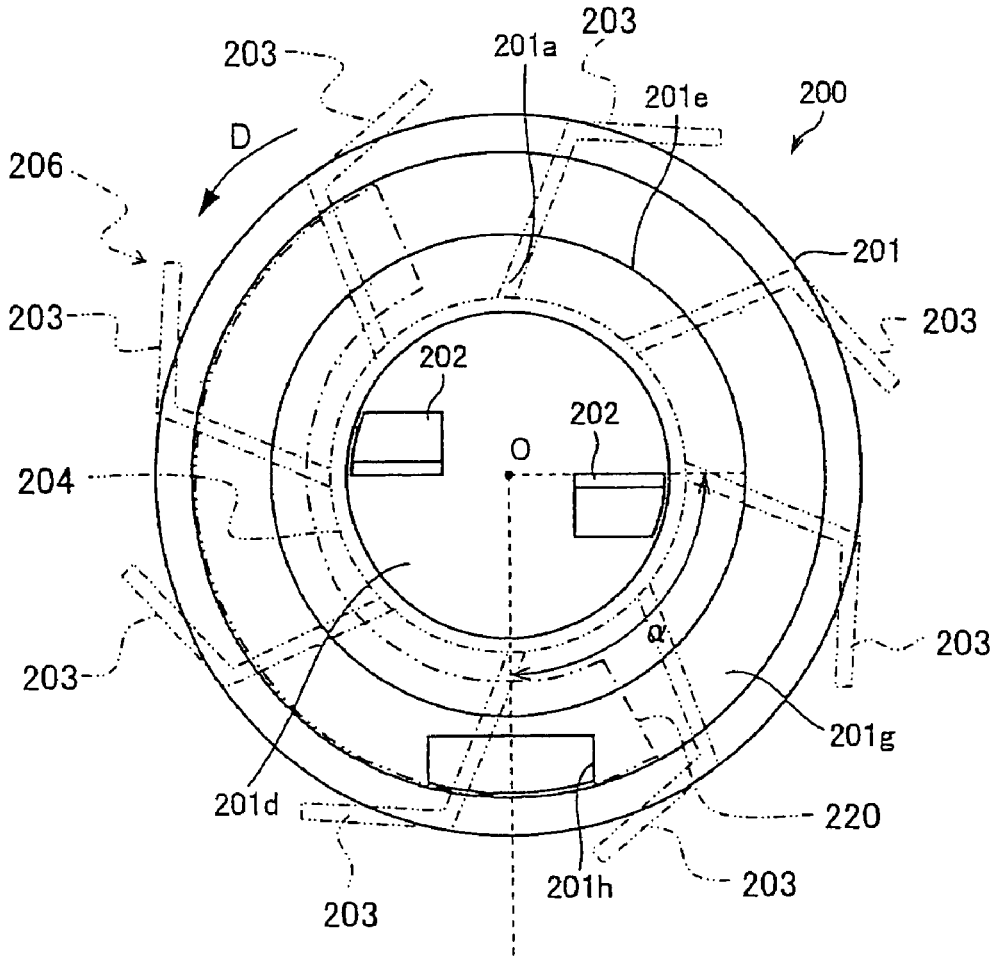
FIG. 12 is a front view showing a configuration of the toner bottle.

FIG. 7A is a side view showing a configuration of a toner supply assembly as a part of the toner supply device according to the present embodiment; FIG. 7B is a front view of the toner supply assembly, viewed from the end face side from which toner is supplied; FIG. 8 is a side view of the front end part of a toner bottle as a part of the toner supply assembly; FIG. 9 is a side view showing a configuration when scrapers for toner conveyance are fitted to the front end part of the toner bottle; FIG. 10 is an illustrative view showing one example of the scrapers; FIG. 11 is an illustrative view schematically showing a case where the scrapers shown in FIG. 10 are fitted to the toner bottle; and FIG. 12 is a front view showing a configuration of the toner bottle.

In the present embodiment, any of toner supply assemblies 500*a*, 500*b*, 500*c* and 500*d* for respective toner supply devices 100 (100*a*, 100*b*, 100*c* and 100*d*) mounted in image forming apparatus 1 is assumed to have an identical configuration.

As shown in FIGS. 2 and 7A, toner supply device 100 is mainly composed of a toner bottle (toner container) 200 that is filled with toner as a developer, a toner supply assembly 500 having a bottle holder (toner container holder) 300 that rotatably holds the toner bottle 200 at its one end, and a toner supply assembly mounting mechanism (toner feed device) 600 to which the toner supply assembly 500 is mounted so as to feed toner to developing unit 23.

Provided on the bottom of bottle holder 300 (the lower side when toner supply device 100 is mounted in image forming apparatus 1) is a shutter mechanism 400 for opening and closing an aftermentioned toner discharge port for discharging the toner fed from toner bottle 200 to the outside of bottle holder 300, as shown in FIG. 7B.

When the toner discharge port of bottle holder 300 is opened by shutter mechanism 400, the toner discharge port and supply passage part 612 as a part of toner supply assembly mounting mechanism 600 are connected to each other so that the toner supplied from toner bottle 200 is fed to developing unit 23 by way of supply passage part 612 that is connected to developing unit 23.

As shown in FIG. 7A, toner bottle 200 is comprised of a main part 201 having an approximately cylindrical shape. When the end of main part 201 on the side supported by bottle holder 300 is called a front end part 201*a*, this front end part 201*a* is formed with an opening (described later) for discharging toner. The other end of main part 201 on the opposite side from front end part 201*a*, namely, rear end 201*b* is closed.

Formed on the peripheral side of main part 201 are a plurality of slots 201*c* which are depressed towards the rotational axis X. Here, on the interior side of main part 201, the parts corresponding to slots 201*c* form ribs that are projected towards the rotational axis X side.

The grooves formed between these ribs function as guide grooves for guiding the toner stored in main part 201 from rear end part 201*b* toward front end part 201*a*.

Herein, slots 201*c* are spirally formed as shown in FIG. 7A or inclined in such a manner that lower side in gravitational direction is inclined toward front end part 201*a* while upper side in anti-gravitational direction is inclined toward rear part 201*b* so that they move toward front end part 201*a* when main part 201 rotates about the rotational axis X clockwise (in the Q-direction) viewed from the front end side. With this configuration, as toner bottle 200 rotates in the Q-direction, the toner held in the toner bottle 200 can be conveyed from rear end part 201*b* to front end part 201*a* of main part 201.

Here, slots 201*c* may have any shape as long as they can convey the toner stored in main part 201 from rear end part 201*b* toward front end part 201*a*.

As shown in FIG. 8, front end part 201*a* is formed to be a cylindrical shape having a smaller diameter than that of the central part of main part 201. A pair of ribs 202, 202 are projected outward from the front end face 201*d* of front end part 201*a*.

These ribs 202, 202 are adapted to be engaged with an actuator of an unillustrated drive when toner supply device 100 is mounted to image forming apparatus 1. With this arrangement, a drive force from the actuator is transferred by way of ribs 202 and 202 to toner bottle 200 of toner supply device 100 so that it is rotated.

As shown in FIGS. 9 and 10, peripheral surface 201*e* of front end part 201*a* is formed with a toner conveying means 206 which is constructed of a plurality of scrapers (toner conveyors) 203 for conveying toner and a fixing member (toner conveyor attachment) 204 on which scrapers 203 are integrally fixed.

Scrapers 203 are each formed of a plate-like elastic resin such as rubber etc., and arranged approximately radially outwards and equi-angularly at eight positions on the peripheral surface of fixing member 204, as shown in FIGS. 10 to 12. Each scraper 203 is formed in an inverted, approximately open-V section with its free end side bent to the upstream side (to the rear) with respect to the rotational direction (the direction indicated by arrow D in FIG. 12) of toner bottle 200.

In the present embodiment, the part of scraper 203, extending radially from fixing member 204 functions as a toner conveying portion 203*a* and the part that is flexed to the upstream side (rear side) with respect to the rotational direction of toner bottle 200 functions as a lid portion 203*b*.

Figure 13A:
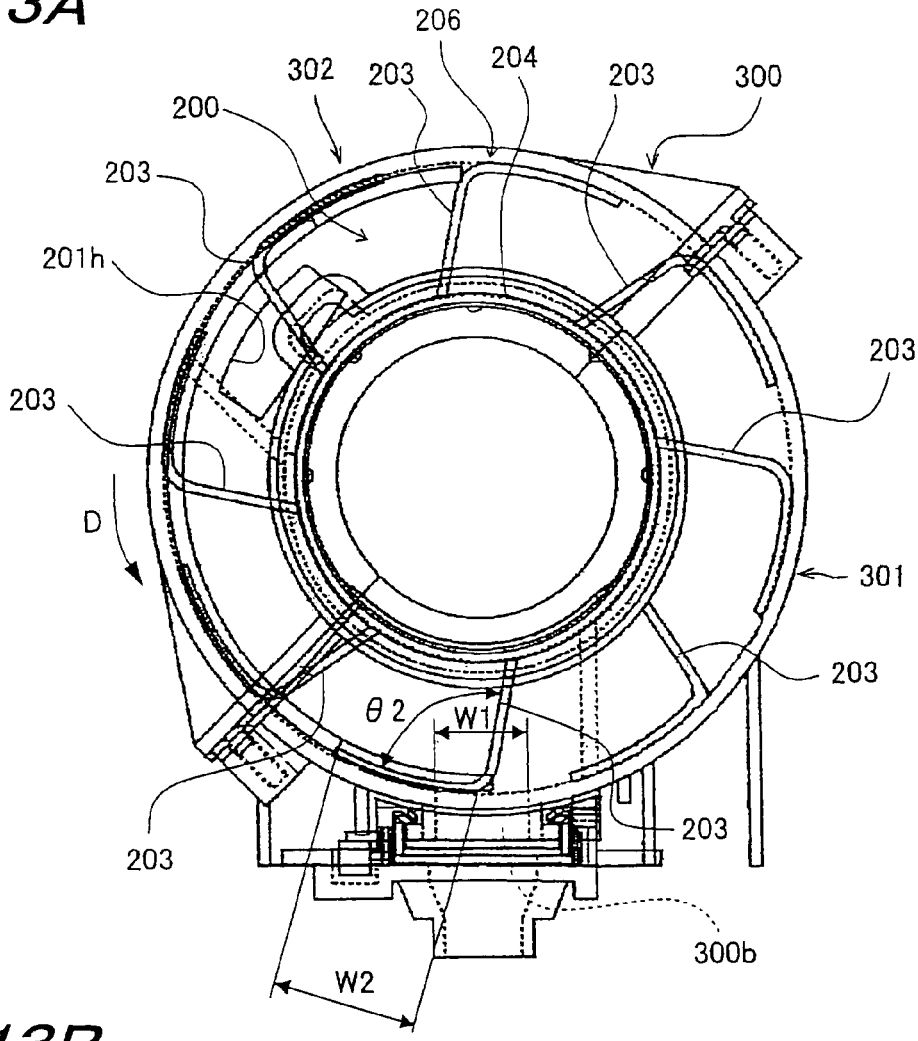
FIG. 13A is a front view showing a configuration of a bottle holder that constitutes the toner supply device.
Figure 13B:
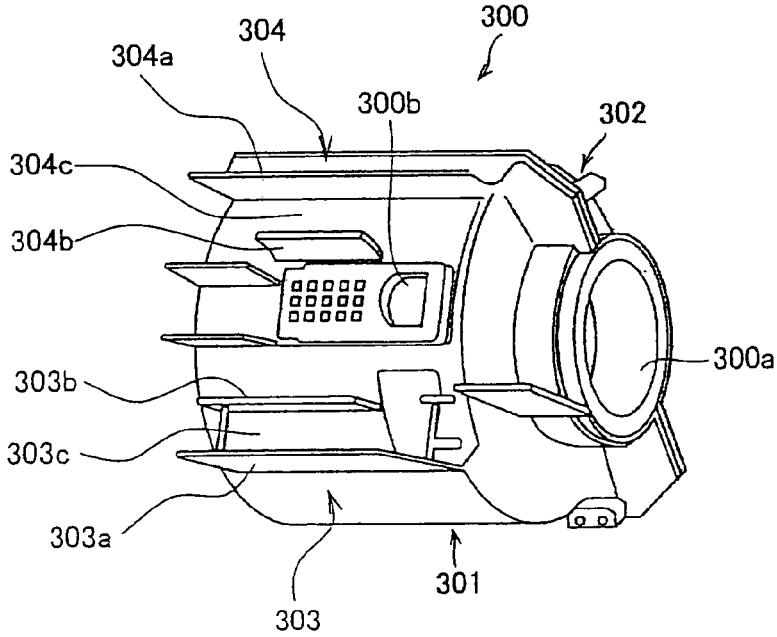
FIG. 13B is a perspective view showing the bottle holder, when it is viewed from the rear side.

Toner conveying portion 203*a* is formed longer than the size of the toner conveyance space in bottle holder 300, so that, when toner conveying means 206 fitted on toner bottle 200 is assembled inside bottle holder 300 and the toner bottle 200 is rotated, the free end side of the scraper is tilted to the upstream side (rearwards) with respect to the toner bottle's direction of rotation (see FIGS. 13A and 13B).

This arrangement is aimed at scraping out the toner that is accumulated in toner discharge chamber 300*d* (FIG. 15) efficiently. However, if the length of toner conveying portion 203*a* of scraper 203 is too long, its friction with the inner peripheral surface of bottle holder 300 becomes greater, causing increase in rotational load. Accordingly, it is preferred that the length of the toner conveying portion is set at a size that will not cause sharp increase of the rotational load.

Lid portion 203*b* is formed so that the length W2 that comes into sliding contact with the inner peripheral surface of bottle holder 300 is longer than the opening length W1 of toner discharge port 300*b*. That is, lid portion 203*b* is constructed so as to completely cover the opening of toner discharge port 300*b* when it opposes toner discharge port 300*b* (see FIGS. 13A and 13B).

The opening angle between toner conveying portion 203*a* and lid portion 203*b* is set so that θ1>θ2, where θ1 is the angle when scraper 203 shown in FIG. 10 is set free and θ2 is the angle when scraper 203 is assembled inside bottle holder 300 (FIG. 13A). The difference in opening angle makes it possible to bring lid portion 203*b* into close contact with toner discharge port 300*b* by the repulsive force of scraper 203.

As shown in FIG. 10, fixing member 204 has an annular shape, made up of a material having elasticity (a general elastic resin such as rubber etc.), having an inside diameter marginally smaller than the outside diameter of front end part 201*a* (FIG. 9) and being formed with projections 204*a* (FIG. 10) on the inner peripheral surface thereof.

These projections 204*a* are adapted to fit into cutouts 201*f* that are previously formed on the front end part 201*a*, as shown in FIG. 11.

In the present embodiment, use of this fixing member 204 makes it simple to arrange scrapers 203 on main part 201 by enlarging the ring part slightly and setting it on peripheral surface 201*e* (FIG. 8) of front end part 201*a*. Moreover, it is possible to reliably fix fixing member 204 to front end part 201*a* by fitting projections 204*a* of fixing member 204 into cutouts 201*f* formed on peripheral surface 201*e* of front end part 201*a*. That is, this arrangement enables fixing member 204 to be driven integrally with front end part 201*a* without it running idly over peripheral surface 201*e* of front end part 201*a*.

Here, scrapers 203 may be directly provided on peripheral surface 201*e* of front end part 201*a*.

Formed on an end face 201*g* that forms a step with front end part 201*a* in main part 201 is a bottle-side toner discharge port 201*h* for discharging the toner held in main part 201, as shown in FIG. 12.

Here, in the present embodiment, this bottle-side toner discharge port 201*h* is formed in an essentially rectangular shape, but the opening of the discharge port should not be limited to this and may have an approximately square-shaped, polygonal, circular or any other shaped configuration as long as it will not hinder discharge of toner.

Further, as shown in FIG. 12, scraper 203 is adjusted and positioned so that its center position forms a predetermined angle α with the center of bottle-side toner discharge port 201*h* when fixing member 204 is attached to the bottle.

Here, scrapers 203 are preferably disposed at positions so as not to disturb toner discharge from bottle-side toner discharge port 201*h*. As long as this condition is satisfied, any angle can be selected as angle α. In order to reliably prevent failures of toner discharge from bottle-side toner discharge port 201*h*, angle α is preferably set at 90 deg.

Toner discharged from bottle-side toner discharge port 201*h* is collected inside bottle holder 300 that is provided so as to cover front end part 201*a*. Bottle holder 300 is formed with a toner discharge port (which will be described later) for discharging the collected toner.

As shown in FIG. 12, bottle-side toner discharge port 201*h* is temporarily closed by a sealing element 220 just before toner bottle 200 starts rotating to perform the operation of supplying toner to developing unit 23.

Sealing element 220 is formed in an arc shape with a flexible material and is configured so that it peels off toner bottle 200 to release bottle-side toner discharge port 201*h* when toner bottle 200 starts rotating.

Next, bottle holder 300 as a constituent of toner supply device 100 will be described in detail with reference to the drawings.

Figure 14A:
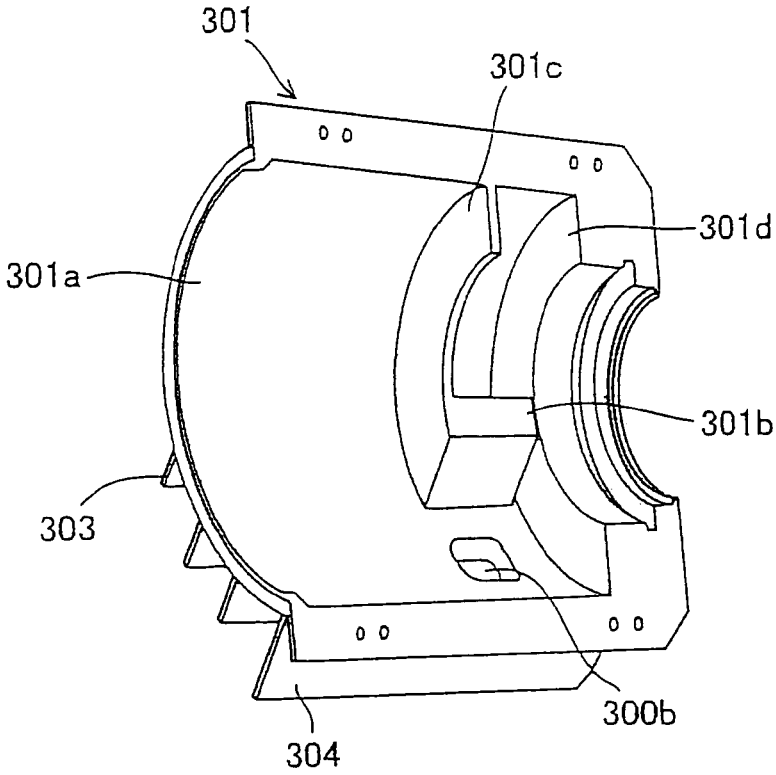
FIG. 14A is a perspective view showing a first casing that constitutes the bottle holder.
Figure 14B:
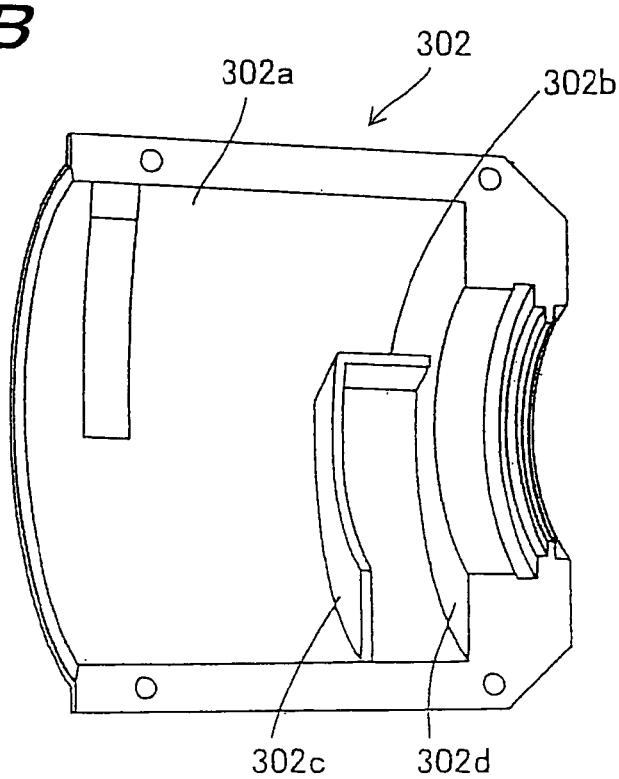
FIG. 14B is a perspective view showing a second casing that constitutes the bottle holder.
Figure 15:
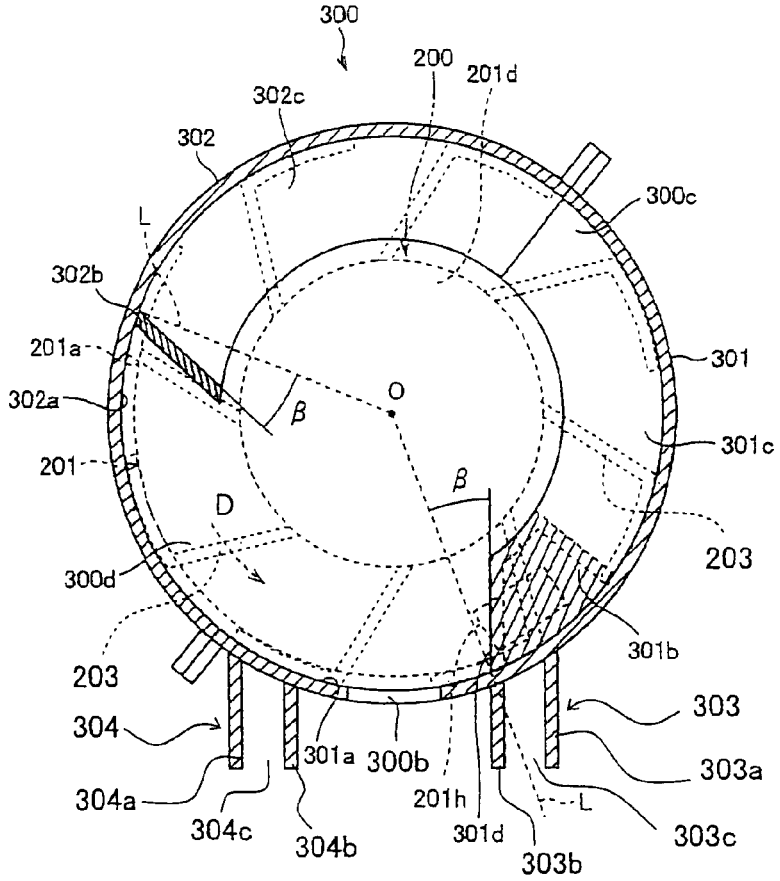
FIG. 15 is an illustrative view showing a positional relationship between a toner discharge chamber of the bottle holder and toner bottle's scrapers.
Figure 16:
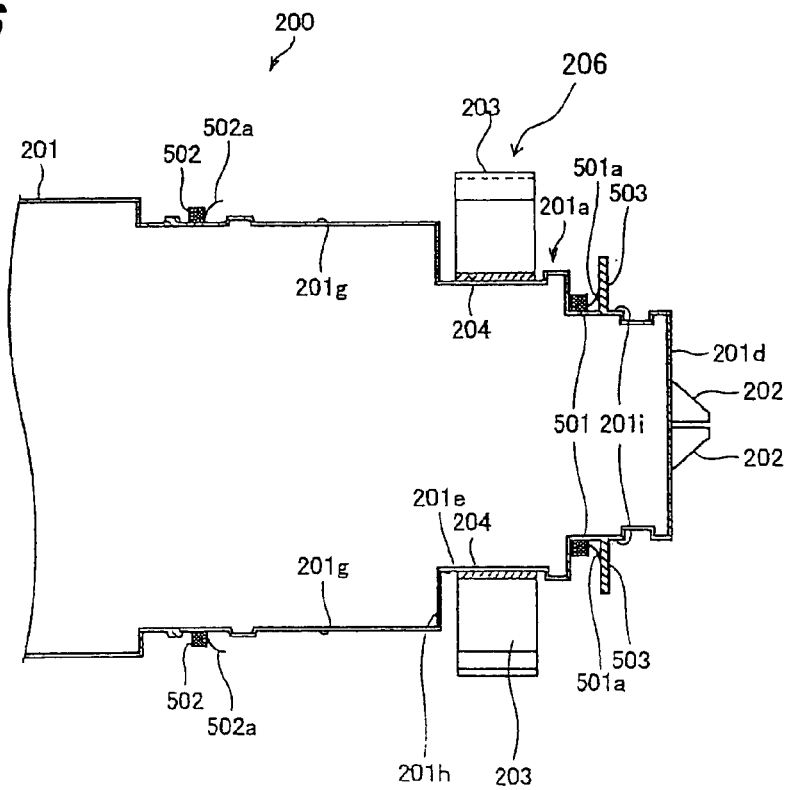
FIG. 16 is a schematic sectional view showing a configuration of the front end part of the toner bottle.

FIG. 13A is a front view showing a configuration of a bottle holder that constitutes a toner supply device according to the present embodiment; FIG. 13B is a perspective view showing the bottle holder when it is viewed from the rear side; FIG. 14A is a perspective view showing a first casing that constitutes the bottle holder; FIG. 14B is a perspective view showing a second casing that constitutes the bottle holder; FIG. 15 is an illustrative view showing a positional relationship between a toner discharge chamber of the bottle holder and scrapers of the toner bottle; and FIG. 16 is a schematic sectional view showing a configuration of the front end part of the toner bottle.

As shown in FIGS. 7A and 7B described above, bottle holder 300 has an approximately cylindrical configuration, and is composed of a first casing 301 and second casing 302, joined to each other so as to cover front end part 201*a* of main part 201. At the end of the bottle holder 300 an opening 300*a* is formed so as to expose at least ribs 202 which are disposed at front end face 201*d* of front end part 201*a*.

Formed on the exterior of first casing 301 are a pair of plate-like first and second fixing structures (guide portions) 303 and 304 arranged parallel to each other, for fixing toner supply device 100 to image forming apparatus 1. Shutter mechanism 400 for controlling discharge of the toner fed from toner supply device 100 to the outside is arranged between these first and second fixing structures 303 and 304.

Accordingly, in order to make shutter mechanism 400 function correctly, the heights of first and second fixing structures 303 and 304 are adjusted so as to assure a clearance between bottle holder 300 and image forming apparatus 1.

Further, in first fixing structure 303, a pair of rib pieces 303*a* and 303*b* are arranged a predetermined distance apart from one another, forming a guide portion 303*c* extending in the axial direction of toner bottle 200. Also in second fixing structure 304, a pair of rib pieces 304*a* and 304*b* are arranged similarly, forming a guide portion 304*c* along the axial direction.

As shown in FIGS. 13A and 13B, bottle holder 300 has toner discharge port 300*b* formed on the bottom side of first casing 301, specifically between first fixing structure 303 and second fixing structure 304. This toner discharge port 300 bis adapted to be opened and closed by shutter mechanism 400.

As shown in FIG. 14A, in first casing 301, a first dam portion 301*b* for holding back the toner is formed on the inner peripheral surface, designated at 301*a* near the aforementioned toner discharge port 300*b* and a wall portion 301*c* is extended from this first dam portion 301*b* toward the side opposite to toner discharge port 300*b*. This wall portion 301*c* is arranged a predetermined distance apart from one end face or abutment surface 301*d* inside first casing 301. This distance is specified to be marginally greater than the width of the aforementioned scrapers 203.

Similarly to the first casing 301, second casing 302 is constructed as shown in FIG. 14B so that a second dam portion 302*b* for holding back the toner is formed on the inner peripheral surface, designated at 302*a* and a wall portion 302*c* is extended from this second dam portion 302*b*. This wall portion 302*c* is arranged a predetermined distance apart from one end face or abutment surface 302*d* inside second casing 302. This distance is specified to be marginally greater than the width of the aforementioned scrapers 203.

Joining first casing 301 and second casing 302 constitute the bottle holder 300 as shown in FIG. 13B.

When first casing 301 and second casing 302 are joined, a first space 300*c* is defined by enclosure of first dam portion 301*b* of first casing 301, second dam portion 302*b* of second casing 302, wall portions 301*c* and 302*c*, as shown in FIG. 15.

In the present embodiment, this first space 300*c* is referred to as a toner discharge control chamber for limiting discharge of toner, while the space (second space) other than the first space, between first dam portion 301*b* and second dam portion 302*b*, is designated at 300*d* and referred to as a toner discharge chamber, which functions to discharge the toner from toner bottle 200 after its temporal storage.

Toner discharge control chamber 300*c* is not a space from which toner is actually discharged, but functions as a space for allowing scraper 203 that has come over first dam portion 301*b* to pass therethrough. In this case, though some toner which has ridden over first dam portion 301*b* with scrapers 203 exists in toner discharge control chamber 300*c*, this toner will be scraped out from the second dam portion 302*b* side by rotational movement of scrapers 203.

On the other hand, toner discharge chamber 300*d* functions as a space for temporarily storing the toner discharged from bottle-side toner discharge port 201*h* of toner bottle 200.

Here, first dam portion 301*b*'s abutment 301*d* with scraper 203 is inclined in the rotational direction of scraper 203 (in the direction of the arrow in the drawing) as shown in FIG. 15 so that scraper 203 can ride over it properly. That is, abutment surface 301*d* is inclined so that it goes away in the rotational direction of scraper 203 from a normal L from rotational center O of toner bottle 200.

In other words, first dam portion 301*b* is disposed on the upstream side of the scraper 203's direction of toner conveyance, and first dam portion 301*b*'s abutment surface 301*d* with scraper 203 is arranged as a slope forming a predetermined angle β with normal L from the rotational center O, to thereby define toner discharge chamber 300*d*. This angle β is determined as appropriate depending on the scraper 203's material, length and other factors.

As another feature, first dam portion 301*b* is disposed slightly away from toner discharge port 300*b* in rotational direction of the scraper 203. This arrangement enables easy accommodation of toner in toner discharge chamber 300*d*. In this way, by making toner easily be stored in toner discharge chamber 300*d*, it is possible to keep constant the amount of toner supply to be discharged through toner discharge port 300*b*. Thus, it is possible to realize stable toner supply.

Similarly to first dam portion 301*b*, second dam portion 302*b* is formed so that its abutment surface 302*d* with scraper 203 (the surface on the toner discharge control chamber 300*c* side) is arranged as a slope forming a predetermined angle β with normal L from the rotational center O, to thereby define toner discharge chamber 300*d*. This angle β is determined as appropriate, depending on the scraper 203's material, length and other factors.

In connection to the above, the distance between first dam portion 301*b* and second dam portion 302*b* on the toner discharge chamber 300*d* side should at least have a distance that will not close toner discharge port 300*b*. Since it is necessary to accumulate a certain amount of toner in toner discharge chamber 300*d* from a viewpoint of stable toner supply, the distance should be specified as appropriate in accordance with the desired amount of toner being stored.

In addition, though the aforementioned scraper 203 was mentioned to have a plate-like configuration it should not be limited to this. For example, the scraper may have an approximately V-shaped cross-section. If scraper 203 has an approximately V-shaped cross-section, it can provide sealing function of sealing between the inner peripheral surface of bottle holder 300 and toner bottle 200, hence no separate sealing member is needed.

In accordance with the toner supply assembly 500 thus constructed, since toner bottle 200 is rotatably supported by bottle holder 300, there must be a certain amount of clearance between toner bottle 200 and bottle holder 300. Therefore, if no suitable seal is provided between toner bottle 200 and bottle holder 300, toner will leak out from other than toner discharge port 300*b* of bottle holder 300.

To deal with this, in the present embodiment, two V-rings 501 and 502 for providing a sealing function are attached on front end part 201*a* of main part 201 of toner bottle 200, as shown in FIG. 16. V-ring 501 is fitted on a peripheral surface 201*i* of front end part 201*a* at a position outside the position where scrapers 203 are fixed, while V-ring 502 is fitted at the end surface, designated at 201*g*, of front end part 201*a* at a position inside the position where scrapers 203 are fixed.

Arranged further outside of the position where V-ring 501 is fitted is a slip ring 503 of a plate-like annular member for creating clearance between toner bottle 200 and bottle holder 300 and allowing toner bottle 200 to rotate smoothly.

V-ring 501 is attached to main part 201 with its sealing flange 501*a* pressed against slip ring 503 while V-ring 502 is attached to main part 201 with its sealing flange 502*a* pressed against the inner peripheral surface (described later) of bottle holder 300. In this way, these two V-rings 501 and 502 provide sealing function.

Slip ring 503 is fitted rotatably on peripheral surface 201*i* of front end part 201*a* of main part 201 and is adapted to be fixed to the inner peripheral surface of bottle holder 300 when toner bottle 200 is attached to bottle holder 300.

With this arrangement, slip ring 503 can be fixed to the bottle holder 300 side, so that main part 201 of toner bottle 200 will rotate along the inner peripheral surface of the slip ring 503.

Now, one example of slip ring 503 will be described with reference to the drawings.

Figure 17:
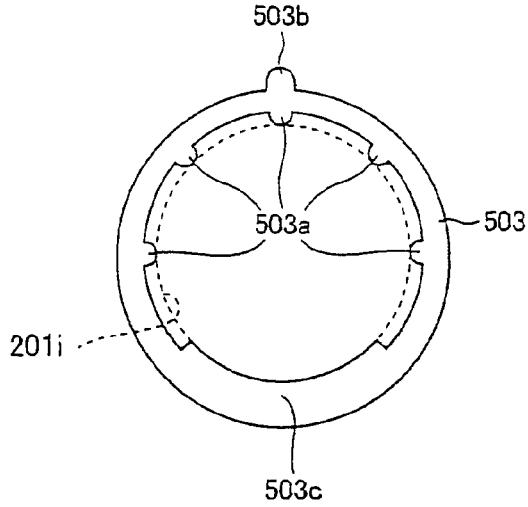
FIG. 17 is a plan view showing a configuration of a slip ring of the toner bottle.
Figure 18:
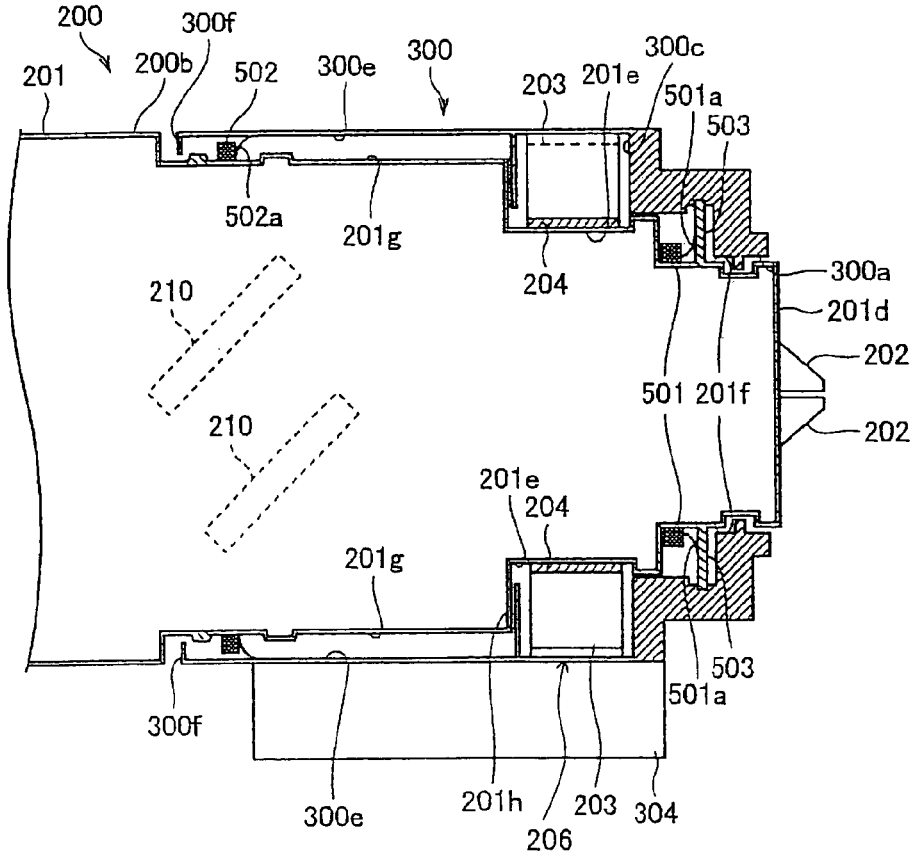
FIG. 18 is a schematic sectional view showing the bottle holder attached to the front end part of the toner bottle.

FIG. 17 is a plan view showing a configuration of the slip ring of a toner bottle as a part of the toner supply device according to the present embodiment, and FIG. 18 is a schematic sectional view showing the bottle holder attached to the front end part of the toner bottle.

As shown in FIG. 17, slip ring 503 is configured so that its inner periphery is formed with a plurality of projections 503*a* that will come into point contact with the fitted surface, i.e., peripheral surface 201*i*, in front end part 201*a* of main part 201 and an essentially arced supporting portion 503*c* that has the same curvature as the peripheral surface 201*i* and hence comes into line contact with peripheral surface 201*i* while a projection 503*b* is formed at the top of the outer peripheral surface. This projection 503*b* is fitted into an unillustrated cutout formed on the inner peripheral surface of bottle holder 300.

Since, in general, slip ring 503 and main part 201 of toner bottle 200 are adapted to slide along each other, it is possible to rotate toner bottle 200 smoothly without load if friction there between is minimized.

Accordingly, provision of multiple projections 503*a* that come into point contact with peripheral surface 201*i* on the inner peripheral surface of slip ring 503 as shown in FIG. 17 reduces the total contact area between toner bottle 200 and slip ring 503, hence making it possible to reduce friction between slip ring 503 and main part 201 of toner bottle 200.

In this way, it is possible to reduce the rotational load which arises due to increase in friction, and hence rotate toner bottle 200 smoothly inside slip ring 503.

It is noted that the shape of slip ring 503 should not be limited to the configuration shown in FIG. 17, but slip ring 503 may have a shape that supports toner bottle 200 at pointed contacts, such as a polygonal shape, for example.

In sum, plate-like slip ring 503 has, on its inner periphery, an arc of line-contact projection 503*c*, which ranges in a predetermined angle at the bottom side and is margined with a predetermined clearance over peripheral surface 201*i* of toner bottle 201 and the remaining arc having a greater radius with multiple projections 503*a* projected inwards in parts therefrom.

With this configuration, the bottle can be supported by arced area at its bottom where the bottle weight acts thereon to prevent abrasion while the other part is supported by essentially pointed contacts, of multiple projections arranged at intervals of a predetermined distance or, of a polygonal shape, whereby it is possible to reduce the sliding load.

Further, since sealing flange 501*a* (FIG. 16) of V-ring 501 is adapted to abut this slip ring 503, it is possible to reliably prevent toner from leaking downward (in the direction of gravity) in bottle holder 300.

Also, V-ring 502 is attached to front end part 201*a* as shown in FIG. 18 so that its sealing flange 502*a* comes into pressing contact with inner peripheral surface 300*e* of bottle holder 300 when front end part 201*a* of main part 201 of toner bottle 200 is supported by bottle holder 300. This construction makes it possible to prevent toner leakage from the rear end 300*f* side of bottle holder 300.

It should be noted that the joint between first casing 301 and second casing 302 is also properly sealed.

As described above, any portion of bottle holder 300 which is likely to cause toner leakage is completely sealed.

Further, formed on the peripheral surface of front end part 201*a* of main part 201 of toner bottle 200 are a plurality of plate-like ribs 210 made of elastic resin etc., and arranged obliquely in parallel to each other, as shown in FIG. 18, so that these ribs 210 will come into pressure contact with inner peripheral surface 300*e* of bottle holder 300 when toner bottle 200 is held by bottle holder 300. With this arrangement, it is possible to push out the toner that has entered the gap between toner bottle 200 and bottle holder 300 as these ribs 210 rotate.

As described, bottle holder 300 is composed of two separate casings, namely first and second casings 301 and 302, being joined together. When these first and second casings 301 and 302 are detachably joined, it is possible to easily replace the expendable sealing elements (V-rings 501, 502, slip ring 503, ribs 202) by unjoining first and second casings 301 and 302 when maintenance of toner supply device 100 is needed. This means improvement in maintenance of toner supply device 100.

In general, in order to avoid toner leakage and other defects, bottle holder 300 and toner bottle 200 need to be formed with dimensional accuracy, particularly in the supported portion of toner bottle 200 by bottle holder 300.

However, since toner bottle 200 is usually formed by blow molding, the toner bottles are prone to include variations in size when they are molded. Similarly, bottle holder 300 is also formed by blow molding, so that the bottle holders are prone to include variations in size when they are molded.

In the above embodiment, since V-ring 502 is made to provide sealing function by pressing its sealing flange 502*a* into contact with inner peripheral surface 300*e* of bottle holder 300 as described above, it is possible to absorb the size variations of bottle holder 300 and toner bottle 200 originating from molding, in the clearance between toner bottle 200 and bottle holder 300, or more clearly, in the space formed between the surface of main part 201 of toner bottle 200 and bottle holder 300.

Next, shutter mechanism 400 will be described with reference to the drawings.

Figure 19A:
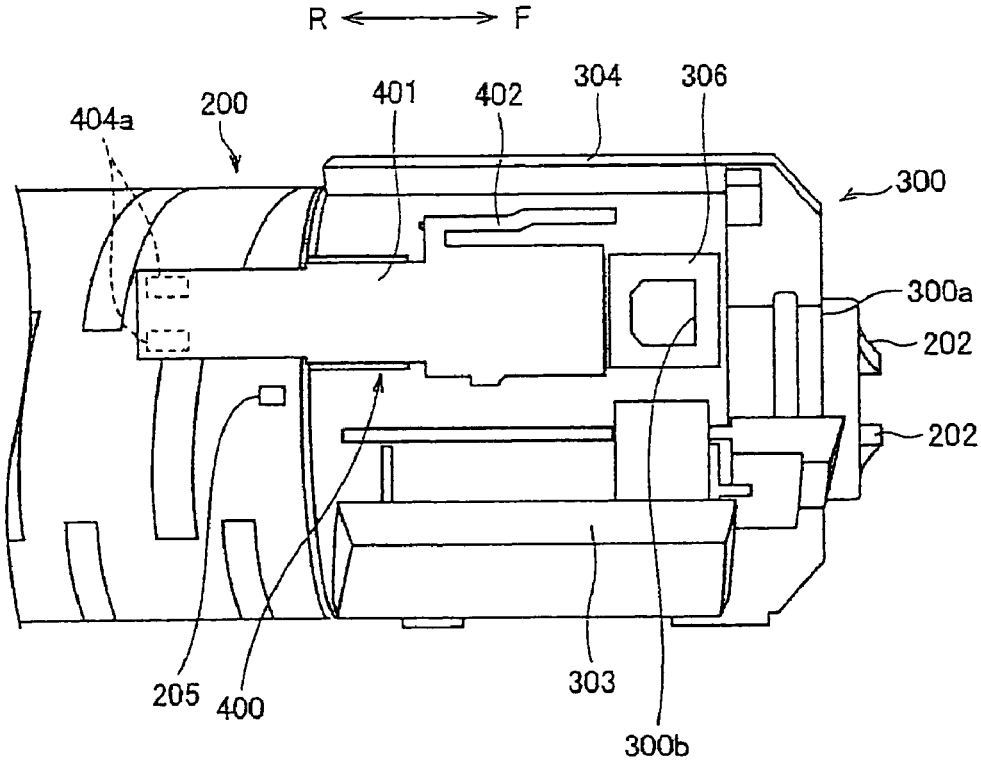
FIG. 19A is an illustrative view showing the bottle holder with its toner discharge port open.
Figure 19B:
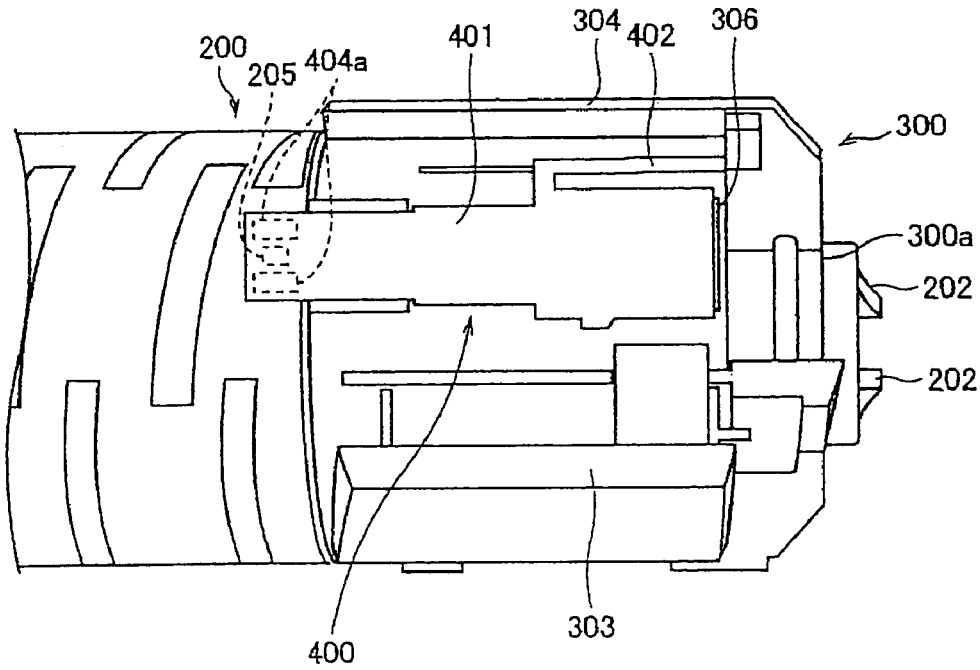
FIG. 19B is an illustrative view showing the bottle holder with the toner discharge port closed by a shutter mechanism.
Figure 20:
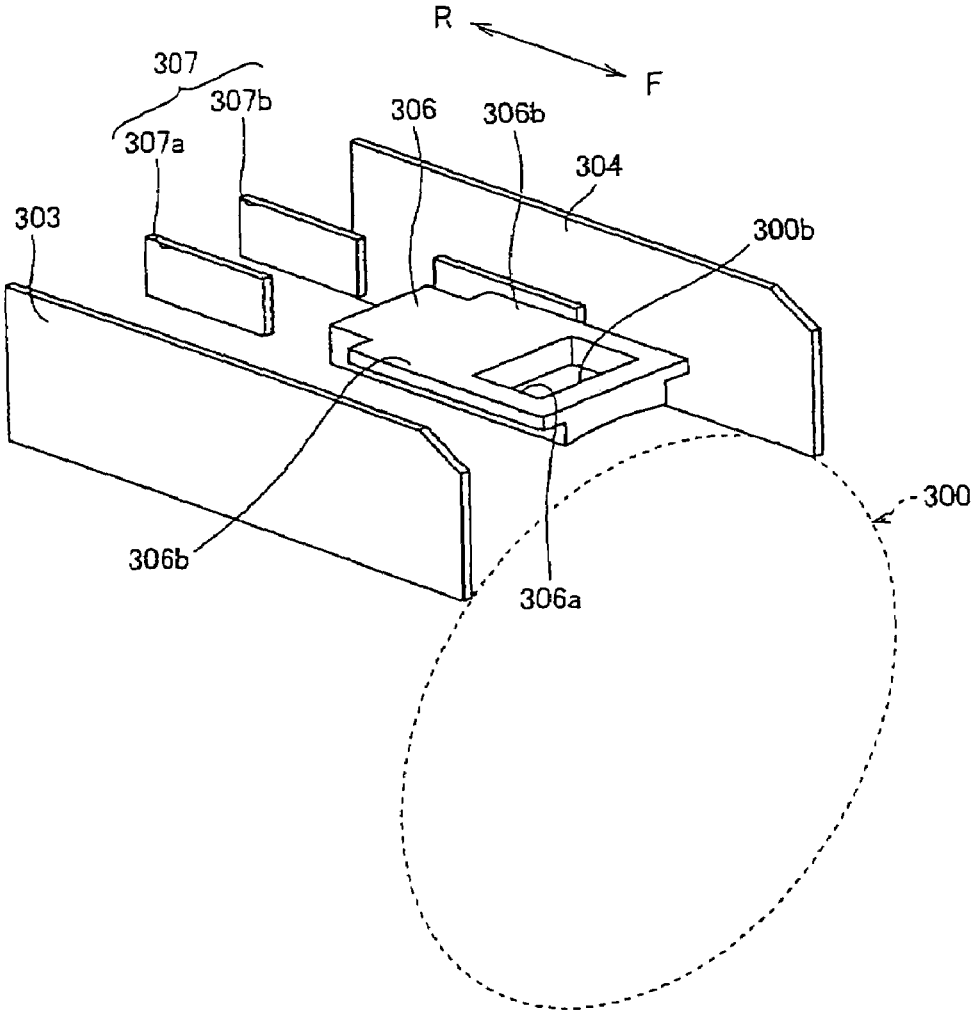
FIG. 20 is an illustrative view showing the schematic structure of the rear side of the bottle holder.

FIG. 19A is an illustrative view showing the bottle holder with its toner discharge port open, FIG. 19B is an illustrative view showing the bottle holder with the toner discharge port closed by a shutter mechanism, and FIG. 20 is an illustrative view showing the schematic structure of the rear side of the bottle holder.

As shown in FIGS. 19A and 19B, shutter mechanism 400 has a plate-like shutter member 401 that is slidable in the directions of arrows F and R, in the bottom of bottle holder 300. In the present embodiment, the side on which ribs 202, 202 of toner bottle 200 are projected from opening 300*a* at the front end of bottle holder 300 is called the front (F) side and the opposite is called the rear (R) side.

In shutter mechanism 400, as shutter member 401 slides in the direction of arrow R, toner discharge port 300*b* of bottle holder 300 is opened, as shown in FIG. 19A. When shutter member 401 slides in the direction of arrow F, toner discharge port 300*b* of bottle holder 300 is closed, as shown in FIG. 19B.

As shown in FIG. 20, bottle holder 300 is formed with first and second guide members 306 and 307 for guiding shutter member 401.

First guide member 306 is a flat plate-like member essentially parallel to the bottom surface of bottle holder 300 and is formed with an opening 306*a* that communicates with toner discharge port 300*b* of the bottle holder 300. Further, the side edge portions 306*b*, 306*b*, of first guide member 306, located at both sides with respect to the directions of arrows F and R, are formed to be thin with the attachment side to bottle holder 300 indented at both sides. These side edge portions 306*b*, 306*b* will function as guide rails for shutter member 401.

On the other hand, second guide member 307 is made up of two guide plates 307*a* and 307*b* with their plate surfaces opposing each other, which are extended in the direction of arrow R on the downstream side, with respect to the direction of arrow R, of the attachment position of first guide member 306. These guide plates 307*a* and 307*b* will function as guide rails for shutter member 401.

Now, shutter member 401 will be described with reference to the drawings.

Figure 21A:
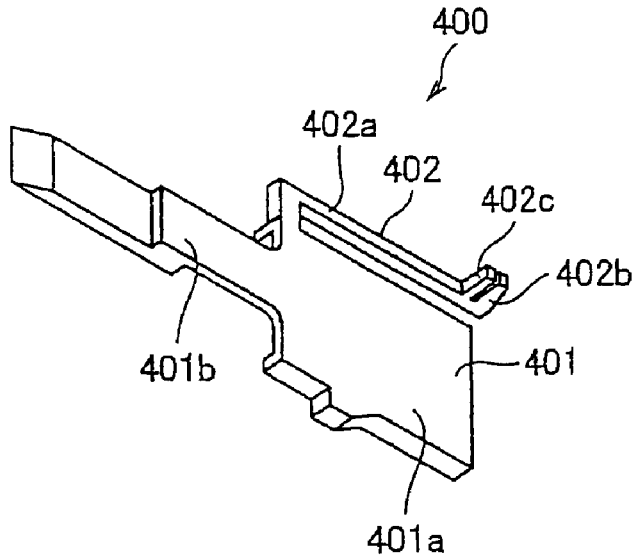
FIG. 21A is a perspective view showing the configuration of a shutter mechanism for a toner supply device in accordance with the present embodiment, when viewed from the front side.
Figure 21B:
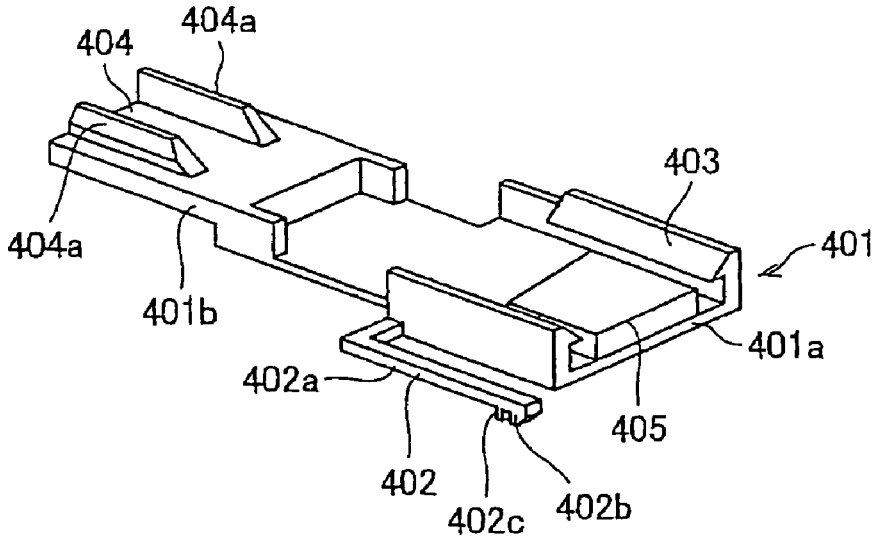
FIG. 21B is a perspective view showing the shutter mechanism when viewed from the rear side.
Figure 22A:
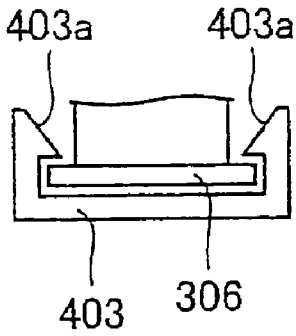
FIG. 22A is an illustrative view showing the relationship between the shutter mechanism and a first guide member of the bottle holder.
Figure 22B:
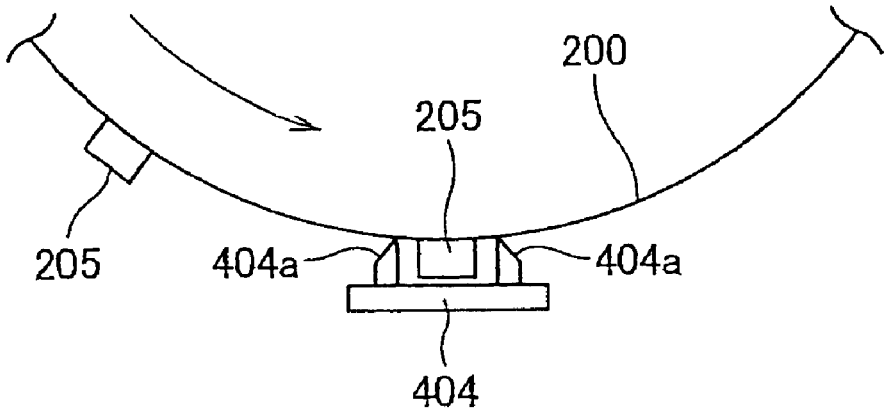
FIG. 22B is an illustrative view showing the relationship between the shutter mechanism and the rotation of the toner bottle.

FIG. 21A is a perspective view, viewed from the front side, showing the configuration of the shutter mechanism for the toner supply device in accordance with the present embodiment, FIG. 21B is a perspective view showing the shutter mechanism when viewed from the rear side, FIG. 22A is an illustrative view showing the relationship between the shutter mechanism and the first guide member of the bottle holder, and FIG. 22B is an illustrative view showing the relationship between the shutter mechanism and the rotation of the toner bottle.

Shutter member 401 is made of plate-like resin, and is composed of a shutter part 401*a* for actually covering the opening and a guide part 401*b* extended from the shutter part 401*a*. As shown in FIG. 21A, shutter part 401*a* is formed with a regulating member 402 for limiting movement of shutter member 401. This regulating member 402 is composed of an essentially L-shaped main piece 402*a* connected at its one end to shutter part 401*a* and first and second hooks 402*b* and 402*c* formed in the end opposite to the connected side with shutter part 401*a* of main piece 402*a*.

A gap of a predetermined distance is formed between first and second hooks 402*b* and 402*c*. The gap distance is determined such that the front end of second hook 402*c* touches first hook 402*b* when the former falls down towards the latter.

On the undersurface of shutter part 401*a*, a first slider 403 that slidably holds first guide member 306 (FIG. 20) having toner discharge port 300*b* of the aforementioned bottle holder 300 is formed extending in the longitudinal direction of shutter member 401, as shown in FIGS. 20 and 21B. That is, as shown in FIG. 22A, first slider 403 slidably holds first guide member 306 by means of a pair of hooks 403*a*, 403*a* arranged at both sides.

On the underside of guide part 401*b*, a second slider 404 that is slidably supported by guide plates 307*a* and 307*b* of second guide member 307 is formed extending in the longitudinal direction of shutter member 401, as shown in FIGS. 20 and 21B. Second slider 404 has a pair of slide plates 404*a*, 404*a* to be guided by guide plates 307*a*, 307*a* of second guide member 307.

Further, formed on the rear side (FIG. 21B) of shutter part 401*a* is a spongy MYLAR seal (or some other type of flexible film material) 405 for hermetically sealing toner discharge port 300*b* of bottle holder 300. The size of MYLAR seal 405 is not particularly limited as long as it can hermetically seal the toner discharge port 300*b* when shutter part 401*a* of shutter member 401 covers toner discharge port 300*b*.

Concerning slide plates 404*a*, 404*a* (FIG. 21B) of second slider 404, when shutter member 401 has moved to the arrow-F side (FIG. 20), or when opening 300*a* of bottle holder 300 is closed, a projecting piece 205 (FIGS. 19A and 19B) formed on the toner bottle 200 surface fits between slide plates 404*a*, 404*a* as shown in FIG. 22B to thereby restrain the toner bottle 200 from rotating. When shutter member 401 is moved in the direction of arrow R, slide plates 404*a*, 404*a* also move in the direction of arrow R to thereby cancel the engagement with projecting piece 205 (FIG. 19A).

This movement cancels restraint on toner bottle 200's rotation. That is, when toner discharge port 300*b* of bottle holder 300 is released so that toner supply device 100 makes a toner supply operation, rotation of toner bottle 200 will not be hindered.

Next, toner supply assembly mounting mechanism 600 will be described with reference to the drawings.

Figure 23:
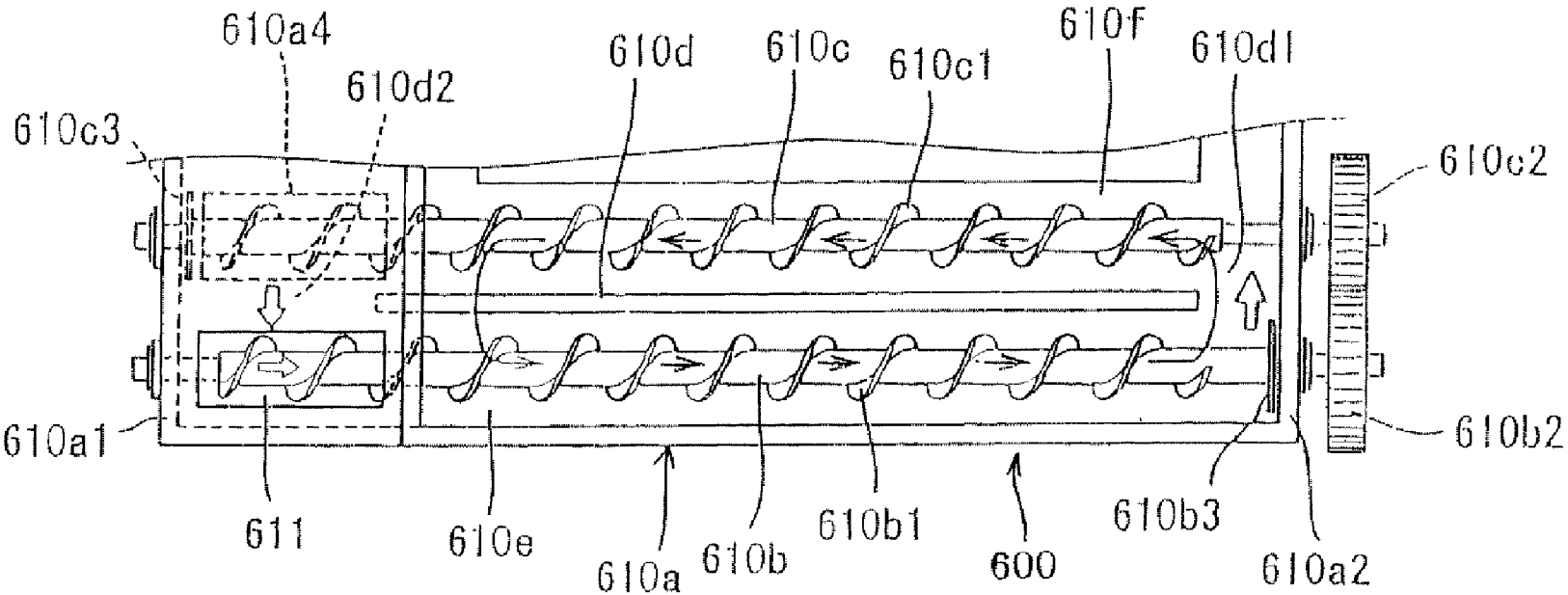
FIG. 23 is an illustrative view showing the structure of the toner supply assembly mounting mechanism.
Figure 24:
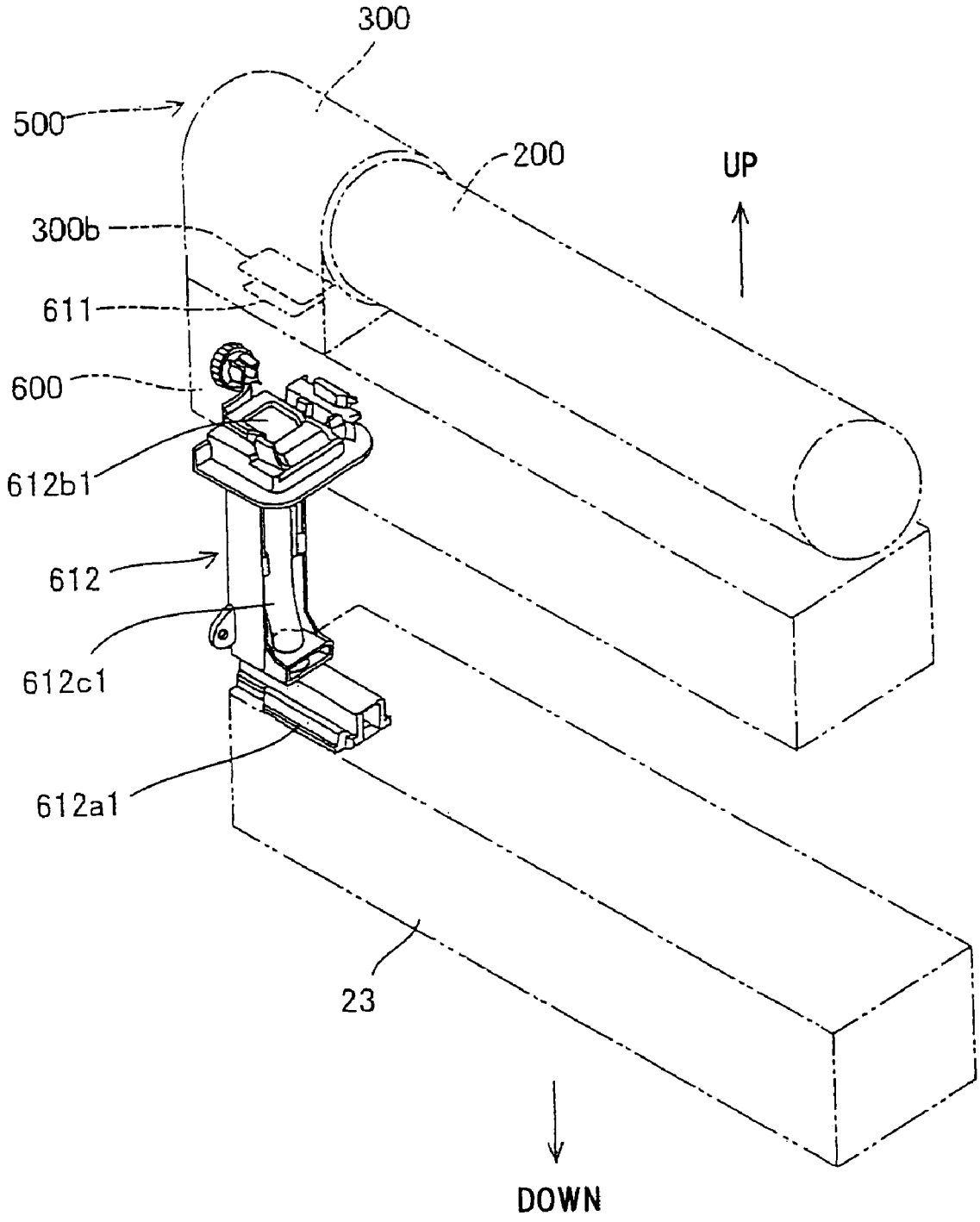
FIG. 24 is an illustrative view showing the structure of a supply passage part for coupling the toner supply assembly mounting mechanism with a developing unit.

FIG. 23 is an illustrative view showing the structure of a toner supply assembly mounting mechanism as a part of a toner supply device according to the present embodiment, and FIG. 24 is an illustrative view showing the structure of a supply passage part for coupling the toner supply assembly mounting mechanism with a developing unit.

As shown in FIGS. 1, 2, 5 and 6, toner supply assembly mounting mechanism 600 is constructed such that toner supply assembly 500 is disposed essentially parallel to, and opposing, developing unit 23 with transfer belt unit 30 disposed there between. Toner supply assembly mounting mechanism 600 is constructed so that two toner supply assemblies 500*a* for storing black toner can be mounted together.

In toner supply assembly mounting mechanisms 600, mount bases 602 (602*a* to 602*d*, FIGS. 5 and 6) onto which toner supply assemblies 500 are mounted are formed lengthwise in the direction (the transfer belt width direction) approximately perpendicular to the transfer belt's direction of conveyance.

As shown in FIG. 5, toner supply assemblies 500 are fixed to corresponding drive mechanisms 701 (701*a* to 701*d*), respectively, on the bottle holder 300 side while toner bottles 200 are fixed by holding belts 702 on the opposite side.

Provided for each drive mechanism 701 is an actuator (not shown) which, when toner supply assembly 500 is mounted to mount base 602, transfers driving force (rotational force) to the bottle by coupling itself with toner bottle 200's ribs 202 (FIG. 7) that are projected from opening 300*a* of the aforementioned bottle holder 300. Usually, the actuator is composed of a motor, and is controlled to drive in accordance with the condition of toner being supplied.

On the other hand, holding belt 702 is adapted to hold toner bottle 200 of the toner supply assembly 500 when toner supply assembly 500 is mounted to mount base 602, and is removably attached to mount base 602. Holding belt 702 is attached to mount base 602 to hold toner bottle 200, leaving a clearance so that the toner bottle 200 is rotatable or touching the toner bottle 200 with such friction as to allow the bottle to rotate.

In toner supply assembly mounting mechanism 600, the mount base 602 on which toner supply assembly 500 is to be mounted, has a toner feed port 611 (611*a*, 611*b*, 611*c* or 611*d*) on the upper surface thereof as shown in FIG. 6. This toner feed port is disposed at one end side on the upper surface where bottle holder 300 of toner supply assembly 500 is mounted, correspondingly to shutter mechanism 400 for the bottle holder 300. On the underside of the mount base, supply passage part 612 (612*a*, 612*b*, 612*c* or 612*d*) for toner conveyance is provided to establish communication from the toner supply port 611 to developing unit 23 that is arranged under toner supply assembly mounting mechanism 600.

Here in FIG. 6, for description convenience, mount base 602*a* corresponding to toner supply assembly 500*a* of black toner is partially omitted.

Supply passage part 612*a* provided in mount base 602*a* for toner supply assembly 500*a* for black toner has two toner feed ports 611*a*, 611*a* corresponding to two toner supply assemblies 500*a*. That is, this supply passage part is constructed so as to receive toner fed from the two ports and feed the toner to single developing unit 23*a* for black toner through toner input port 234*a* (FIGS. 2 and 3) formed in developing unit 23*a*.

Toner supply assembly mounting mechanism 600 is constructed as shown in FIGS. 3 and 23 such that toner fed from toner supply assembly 500 is delivered from toner feed port 611 that is disposed outside the area of the transfer belt with respect to the direction perpendicular to the transfer belt's direction of conveyance, or in short, outside the width W of the transfer belt.

On the other hand, each of mount bases 602*b* to 602*d* of toner supply assemblies 500*b* to 500*d* for cyan, magenta and yellow toners is formed with a casing 610*a* (FIG. 23) that has a box shape elongated in the width direction of the transfer belt. The casing 610*a* incorporates a first toner agitator shaft (toner conveyor means) 610*b* and a second toner agitator shaft (toner conveyor means) 610*c*, arranged parallel to each other along the axis direction of developing roller 231.

The interior of casing 610*a* is divided by a partitioning element 610*d* into a first toner chamber (toner reservoir) 610*e* with first toner agitator shaft 610*b* disposed therein and a second toner chamber (toner reservoir) 610*f* with second toner agitator shaft 610*c* disposed therein.

First and second toner agitator shafts 610*b* and 610*c* have screws 610*b*1 and 610*c*1 for agitating and conveying toner, respectively, and are driven by an unillustrated drive motor by way of drive gears 610*b*2 and 610*c*2 arranged on the other side 610*a*2 of casing 610*a*.

Toner support plates 610*b*3 and 610*c*3 are provided for first and second toner agitator shafts 610*b* and 610*c*, respectively, at their downstream side ends with respect to the direction of toner conveyance so as to receive the toner being conveyed.

Here, the toner agitating means should not be limited to screws 610*b*1 and 610*c*1, but it may be a structure in which a multiple number of agitating vanes tilted with the direction of toner conveyance are formed on the first and second toner agitator shafts 610*b* and 610*c*, for example. Also any other configuration can be used as long as it can achieve the same effect.

Partitioning element 610*d* is formed in casing 610*a* along the casing length or along the first and second agitator shafts 610*b* and 610*c*, having toner chamber communication ports 610*d*1 and 610*d*2 formed near both side walls of casing 610*a* to allow for toner passage between first and second toner chambers 610*e* and 610*f*. These toner chamber communication ports 610*d*1 and 610*d*2 permit toner to circulate from first toner chamber 610*e* to second toner chamber 610*f* and from second toner chamber 610*f* to first toner chamber 610*e*.

On the first end side, designated at 610*a*1, of casing 610*a*, a toner feed port 611 for receiving toner supply from toner bottle 200 arranged on the top thereof is formed while a toner feed port 610*a*4 for delivering the toner from casing 610*a* to supply passage part 612 (FIGS. 2 and 3) that feeds toner to developing unit 23 arranged below is formed.

The opening of toner feed port 611 is formed at a position opposing part of first toner agitator shaft 610*b* for agitating and conveying toner from first end side 610*a*1 to second end side 610*a*2 of casing 610*a*.

On the other hand, the opening of toner feed port 610*a*4 is formed at a position opposing part of second toner agitator shaft 610*c* for agitating and circulatively conveying toner from second end side 610*a*2 to first end side 610*a*1 of casing 610*a*.

Each supply passage part 612 is formed so that its top is integrated with toner supply assembly mounting mechanism 600, and a developing unit attachment portion 612*a*1 for removable attachment to developing unit 23 is provided at the bottom thereof, as shown in FIG. 24.

An opening of a toner input port 612*b*1 for toner input is formed at the top of supply passage part 612, and a toner passage 612*c*1 for toner to pass from this toner input port 612*b*1 to developing unit attachment portion 612*a*1 is provided approximately linearly from top to bottom.

Further, as shown in FIG. 6, at one end side on the top of casing 610*a* of mount base 602, bottle holder guide portions 620, 620 that engage guide portions 303*c* and 304*c* (FIG. 7B) of first and second fixing structures 303 and 304 are projectively formed at the positions opposing first and second fixing structures 303 and 304 (FIG. 7B) of bottle holder 300 when toner supply assembly 500 has been mounted. Bottle holder guide portions 620, 620 are arranged essentially parallel to each other and extended in the longitudinal direction of mount base 602 with toner feed port 611 positioned there between.

Toner feed port 611 of mount base 602 is formed at the position corresponding to shutter member 401 (FIG. 19A) of shutter mechanism 400 provided for bottle holder 300 when toner supply assembly 500 is mounted. In other words, toner feed port 611 is formed at a position so as to be able to receive toner discharged from toner discharge port 300*b* when the toner discharge port 300*b* of bottle holder 300 is released by shutter mechanism 400.

Formed in the vicinity of toner feed port 611 is a projection piece 613 (613*a* to 613*d*, FIG. 6), which engages a hooking portion (described later) of regulating member 402 (FIGS. 19A and 21A) provided for shutter member 401 of shutter mechanism 400 to limit the movement of shutter member 401.

On the side longitudinally opposite to toner feed port 611 of mount base 602, supporters 614*b* to 614*d* (the first supporters not being shown) are provided for supporting the rear end (the end on the side opposite to the mounted portion of bottle holder 300) of toner bottle 200 when toner supply device 100 is mounted is formed.

This supporter 614 is to create a predetermined clearance between toner bottle 200 and mount base 602 and functions to smoothen the rotation of toner bottle 200. Here, the configuration and the like of supporter 614 is not particularly limited; any configuration and material can be used as long as it assures smooth rotation of toner bottle 200.

The forming position of projection piece 613 provided near toner feed port 611 is determined by the regulatory operation of regulating member 402.

Next, how the forming position of projection piece 613 is determined will be described with reference to the drawings.

Figure 25A:
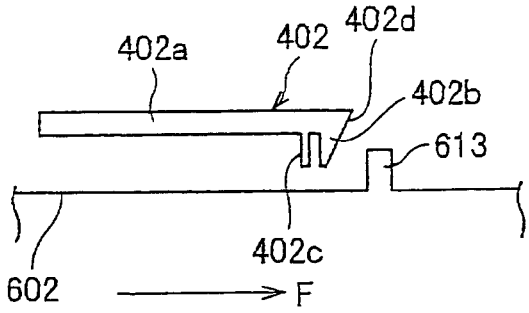
FIG. 25A is an illustrative view showing the positional relationship between a regulating member and a projection piece before the toner supply device is mounted to a mount base.
Figure 25B:
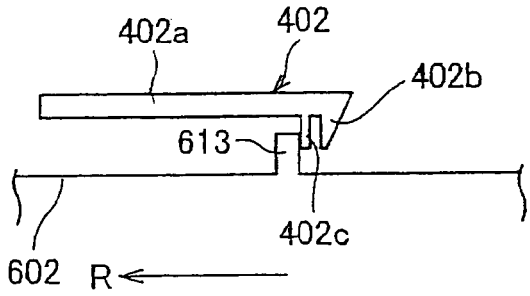
FIG. 25B is an illustrative view showing the positional relationship between the regulating member and the projection piece when the toner supply device has been mounted to the mount base.
Figure 25C:
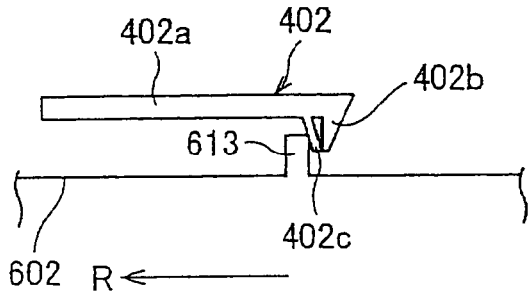
FIG. 25C is an illustrative view showing the positional relationship between the regulating member and the projection piece when the toner supply device is dismounted from the mount base.

FIG. 25A is an illustrative view showing the positional relationship between the regulating member and the projection piece before the toner supply device according to the present embodiment is mounted to the mount base; FIG. 25B is an illustrative view showing the positional relationship between the regulating member and the projection piece when the toner supply device has been completely mounted to the mount base; and FIG. 25C is an illustrative view showing the positional relationship between the regulating member and the projection piece when the toner supply device is dismounted from the mount base.

Projection piece 613 is formed at such a position that shutter member 401 will open toner discharge port 300*b* of bottle holder 300 by its engagement with regulating member 402 when toner supply device 100 has been completely mounted to mount base 602 and will close toner discharge port 300*b* of bottle holder 300 when toner supply device 100 is removed from mount base 602.

Regulating member 402 has first hook 402*b* and second hook 402*c* formed at the front end (on the side of engagement with projection piece 613) of main piece 402*a*, as already mentioned.

First hook 402*b* is disposed at a position more front than second hook 402*c* and its abutment surface 402*d* against projection piece 613 is formed beveled so that it can easily ride over the projection piece 613. Here, abutment surface 402*d* is so inclined that its contact area with the top of projection piece 613 is minimized.

When abutment surface 402*d* of first hook 402*b* is inclined in this way, regulating member 402 is moved in the direction of arrow F from the state shown in FIG. 25A, and first hook 402*b* rides over projection 613 formed on first casing 301. With a further movement of the regulating member in the direction of arrow F, second hook 402*c* also rides over projection 613. From this state, when regulating member 402 is caused to move in the direction opposite to the direction of arrow F, movement of regulating member 402 is obstructed by projection piece 613 and second hook 402*c* (the state shown in FIG. 25B).

Next, how toner supply device 100 is mounted to image forming apparatus 1 will be described.

Toner supply device 100 is adapted to be mounted to toner supply assembly mounting mechanism 600 by sliding the bottle holder 300 side of toner supply assembly 500 over and along mount base 602 of toner supply assembly mounting mechanism 600.

By this sliding movement of toner supply assembly 500, shutter member 401 of shutter mechanism 400, provided for bottle holder 300, opens or closes toner discharge port 300*b* of the bottle holder 300, as shown in FIGS. 25A, 25B and 25C.

Movement of shutter member 401 is controlled by regulating member 402 that is integrally formed with shutter member 401.

In the case where toner discharge port 300*b* of bottle holder 300 is opened by shutter mechanism 400, as shutter member 401 moves in the direction of arrow R, regulating member 402 moves and takes the state shown in FIG. 25B. Then, with a further movement in the direction of arrow R, second hook 402*c* abuts projection piece 613 and falls down to the first hook 402*b* side, as shown in FIG. 25C, so that the first hook 402*b* together with second hook 402*c* ride over projection piece 613 as the movement in the direction of arrow R continues. In this way, toner discharge port 300*b* of bottle holder 300 is made open.

In the case where toner supply assembly 500 is dismounted from toner supply assembly mounting mechanism 600, as toner supply assembly 500 is pulled out from toner supply assembly mounting mechanism 600, the aforementioned actions take place in the reverse order, that is, shutter member 401 moves in the direction of arrow F (FIG. 25A) so that toner discharge port 300*b* of bottle holder 300 is closed.

Next, the operation of supplying toner to developing unit 23 by toner supply device 100 using toner bottle 200 will be described.

Toner bottle 200 is mounted to toner supply assembly mounting mechanism 600 with bottle-side toner discharge port 201*h* sealed with sealing element 220.

When toner is supplied to developing unit 23, driving mechanism 701 provided for toner supply assembly mounting mechanism 600 drives toner bottle 200 to rotate. As a result, sealing element 220 is peeled off toner bottle 200 first to open bottle-side toner discharge port 201*h* of toner bottle 200, so that toner will be able to be supplied from bottle-side toner discharge port 201*h*.

As toner bottle 200 rotates, toner discharged from toner bottle 200 is conveyed and supplied from the interior of bottle holder 300 to toner supply assembly mounting mechanism 600 by means of scrapers 203 that are integrally formed with toner bottle 200, as shown in FIGS. 3 and 13A, and the toner is agitated by the toner supply assembly mounting mechanism 600, then fed to developing unit 23.

When toner supply is halted, the rotation of toner bottle 200 is stopped so as to quit toner conveyance from toner bottle 200. At this point, the movement of toner bottle 200 is controlled by an unillustrated rotational position detecting sensor for sensing toner bottle 200 so that one lid portion 203*b* of multiple scrapers 203 will be positioned to oppose toner discharge port 300*b* of bottle holder 300.

With this arrangement, toner discharge port 300*b* of bottle holder 300 can be closed by lid portion 203*b* of scraper 203 when toner bottle 200 stops rotating, so that it is possible to totally block toner supply. As a result, if image forming apparatus 1 is moved or even shaken, there is no risk of toner being unintentionally delivered from toner supply device 100 to developing unit 23.

Next, toner bottle 200 attached to toner supply device 100 will be described with reference to the drawings.

Figure 26:
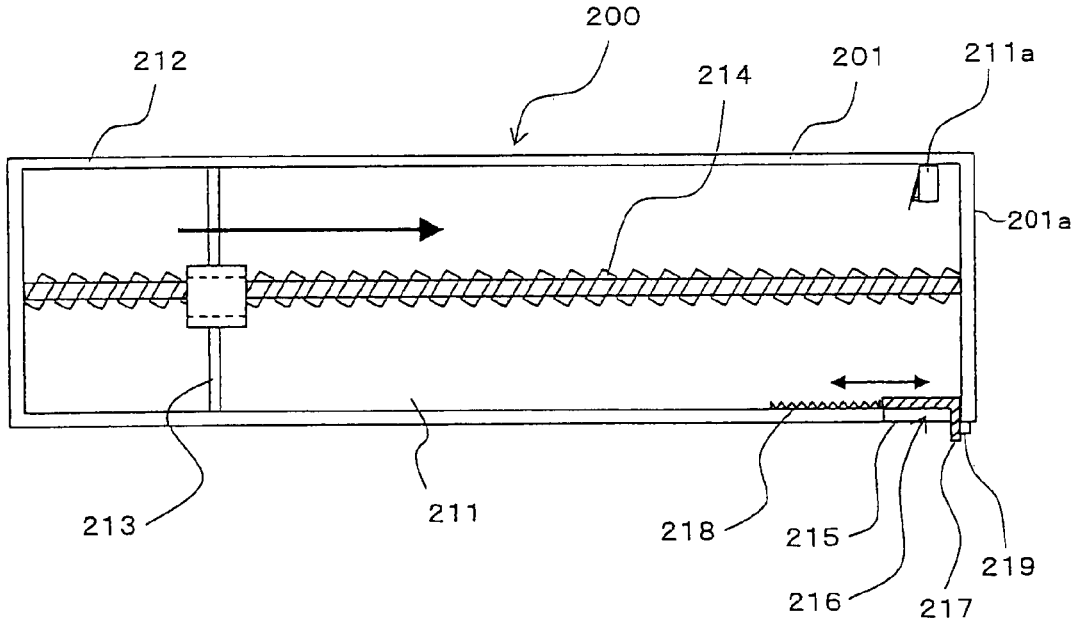
FIG. 26 is a schematic illustrative view showing the internal structure of the toner bottle.

FIG. 26 is a schematic illustrative view showing the internal structure of the toner bottle according to the present embodiment.

As shown in FIG. 26, toner bottle 200 includes a partitioning plate (partitioning member) 213 for separating the interior into a toner storing compartment 211 for storing toner therein and an empty space 212 with no toner therein and a feed shaft (partitioning member moving means) 214 for moving partitioning plate 213 in the axial direction of toner bottle 200, both arranged in main part 201.

Feed shaft 214 is formed of a screw shaft and is rotatably arranged with an unillustrated motor etc. That is, partitioning plate 213 is moved left and right along the axial direction of toner bottle 200 in the drawing as the shaft rotates, so that the volume of toner storing compartment 211 is suitably controlled in accordance with the amount of toner left in toner storing compartment 211.

Arranged on the front end 201*a* side of toner storing compartment 211 is a micro switch (remaining toner quantity detecting means) 211*a* which detects the position of partitioning plate 213 when the volume of toner storing compartment 211 is reduced to a predetermined volume or lower.

That is, micro switch 211*a* is adapted to output a signal by detecting partitioning plate 213 that moves in accordance with the amount of remaining toner when the toner left in toner storing compartment 211 has run short. However, the remaining toner quantity detecting means may use a contact type (mechanical type) sensor, a non-contact type sensor (photo sensor etc.) or any other type, not limited to use of micro switches.

In the front end part 201*a* of toner bottle 200 a toner discharge port 215 is formed at the position opposing the toner feed port 611 (FIG. 6) of toner supply assembly mounting mechanism 600*a* (FIG. 6). Also, an outlet slide shutter 216 for opening and closing the toner discharge port 215 is disposed with it.

Outlet slide shutter 216 is configured so as to be able to open and close the toner discharge port 215 as it slides in the axial direction of toner bottle 200. Formed at the toner bottle 200's front end 201*a* side of this slide shutter 216 is a rib 217 that is projected outwards of toner bottle 200 (downwards in the drawing) to engage an engagement piece 634 (FIG. 27) of toner supply assembly mounting mechanism 600*a*. On the other hand, a spring element (elastic element) 218 that urges outlet slide shutter 216 in the axial direction of toner bottle 200 toward its front side is disposed on the opposite side across outlet slide shutter 216, from the rib 217's side.

Outlet slide shutter 216 is adapted to close toner discharge port 215 by means of spring element 218 when in the normal state or when toner bottle 200 is handled alone or is not set on toner supply assembly mounting mechanism 600*a*. The shutter is able to release toner discharge port 215 from the normal state by opposing the repulsive force of spring element 218.

Further, an engagement piece 219 that abuts a rib 632 (FIG. 27) on toner supply assembly mounting mechanism 600*a* is formed on the front end part 201*a* side of toner bottle 200, at a position more front than rib 217 of outlet slide shutter 216. This rib 632 is smaller in height than rib 217.

The engagement piece 219 abuts the rib 632 of after mentioned in let slide shutter 631 when toner bottle 200 is mounted to toner supply assembly mounting mechanism 600*a*.

Next, toner supply assembly mounting mechanism 600 for the above-described toner bottle 200 will be described with reference to the drawings.

Figure 27:
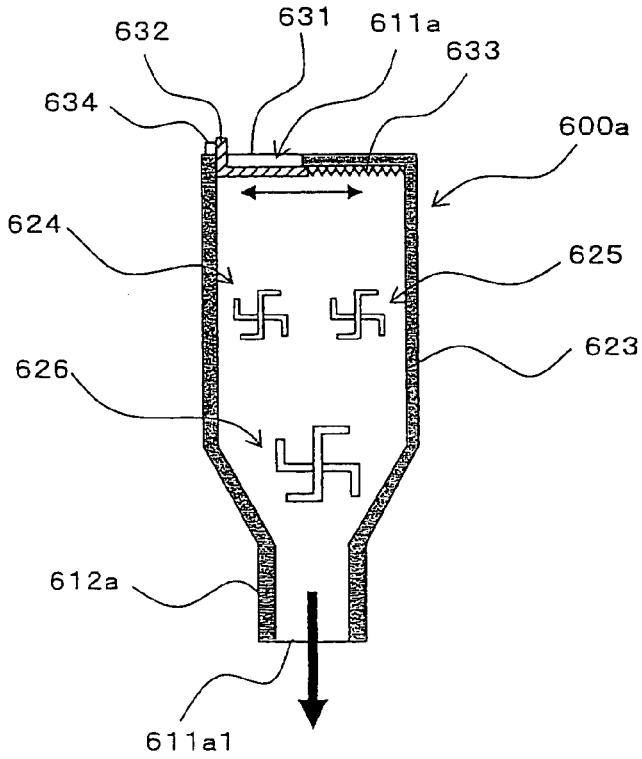
FIG. 27 is a schematic illustrative view showing the configuration of a toner supply assembly mounting mechanism corresponding to the toner bottle.

FIG. 27 is a schematic illustrative view showing the configuration of a toner supply assembly mounting mechanism corresponding to the toner bottle according to the present embodiment.

As shown in FIGS. 6 and 27, toner supply assembly mounting mechanism 600*a* is comprised of a box-shaped casing 623 that forms its exterior and a pair of toner feed ports 611*a*, 611*a* that correspond to two toner bottles 200 formed on the top, and uses the interior of the casing 623 as a temporal reservoir of the toner that is fed from the toner feed ports 611*a*, 611*a*.

In the interior of casing 623, rotors 624, 625 and 626 for agitating stored toner are rotatably supported by unillustrated drive motors. Also, a toner discharge port 611*a*1 for delivering toner to developing unit 23 through toner supply passage part 612*a* is formed at the bottom of casing 623.

Rotors 624 and 625 are laid out correspondingly under toner feed ports 611*a*, 611*a* through which toner is supplied from individual toner bottles 200*a*, 200*a* while rotor 626 is arranged under and between rotors 624 and 625.

Toner feed ports 611*a*, 611*a* are each able to have toner bottle 200 mounted thereto, and as shown in FIGS. 26 and 27, each port has inlet slide shutter 631 corresponding to outlet slide shutter 216 provided at toner discharge port 215 of each toner bottle 200.

Inlet slide shutter 631 is configured to be able to open and close toner feed port 611*a* as it slides in the axial direction of the mounted toner bottle 200. Formed at one end side of inlet slide shutter 631 is a rib 632 that is projected outwards of casing 623 (upwards in the drawing) to engage engagement piece 219 that is formed on the front end 201*a* side of toner bottle 200. On the other hand, a spring element (elastic element) 633 that urges inlet slide shutter 631 in the axial direction of toner bottle 200 to the first side is disposed on the opposite side of inlet slide shutter 631.

Further, inlet slide shutter 631 is adapted to close toner feed port 611*a* by means of spring element 633 when in the normal state or when toner bottle 200 is not set on toner supply assembly mounting mechanism 600*a*. The shutter is able to open toner feed port 611*a* from the normal state by opposing the repulsive force of spring element 633.

Also, on the insert side (left side in the drawing) of toner supply assembly mounting mechanism 600*a*, that is, the side to which toner bottle 200 is inserted, an engagement piece 634 that abuts rib 217 of outlet slide shutter 216 of toner bottle 200 is formed at a position outside rib 632 of inlet slide shutter 631. This engagement piece 634 is smaller in height than rib 632.

This engagement piece 634 is adapted to abut rib 217 of outlet slide shutter 216 of toner bottle 200 when toner bottle 200 is set on toner supply assembly mounting mechanism 600*a*.

In the present embodiment, outlet slide shutter 216 and inlet slide shutter 631 move along the axial direction of toner bottle 200 when toner bottle 200 is mounted onto toner supply assembly mounting mechanism 600*a*, whereby these shutters slide in opposite directions to open their openings.

Next, how toner bottle 200 is mounted to toner supply assembly mounting mechanism 600*a* is described with reference to the drawings.

Figure 28A:
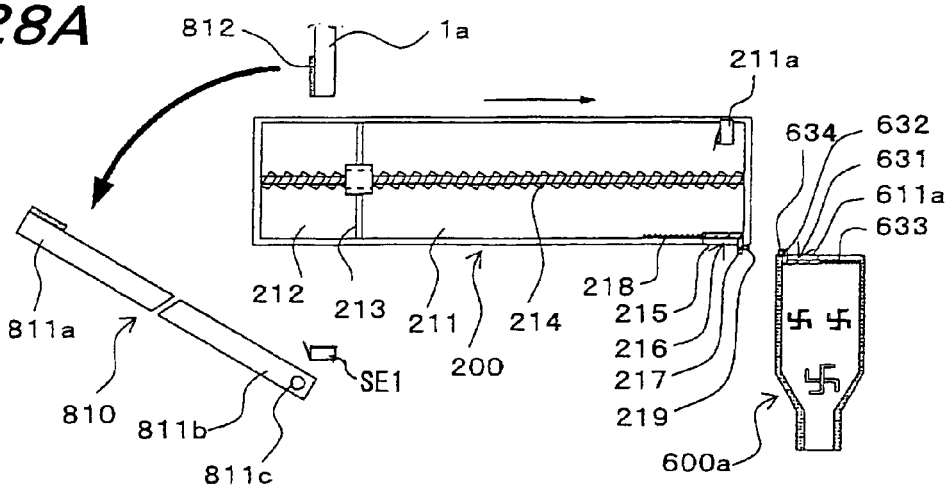
FIG. 28A is a schematic illustrative view showing a state where the toner bottle is going to be set onto the toner supply assembly mounting mechanism.
Figure 28B:
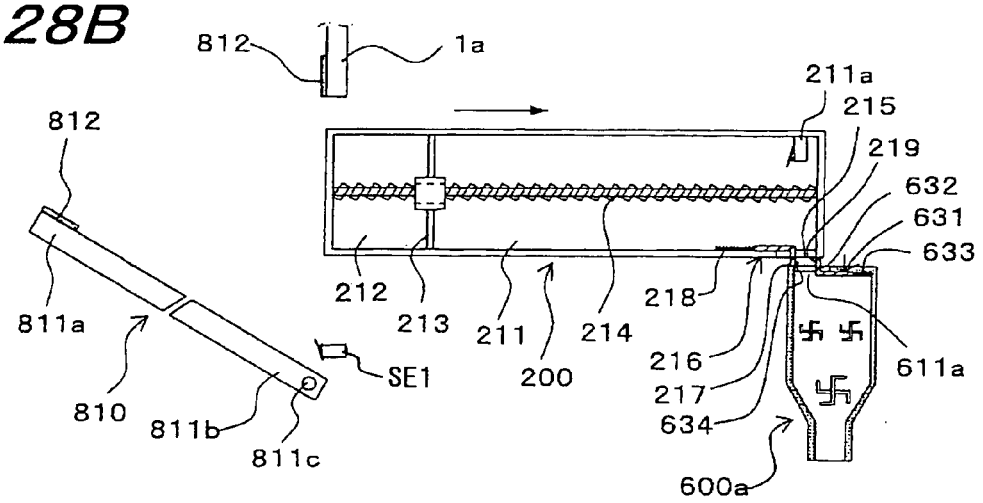
FIG. 28B is a schematic illustrative view showing a state where the toner bottle is being set on the toner supply assembly mounting mechanism.
Figure 28C:
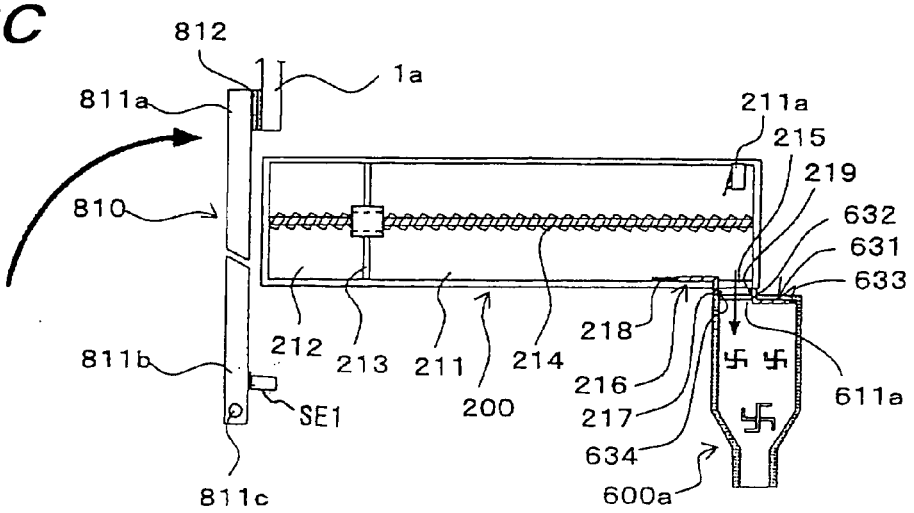
FIG. 28C is a schematic illustrative view showing a state where the toner bottle has been set on the toner supply assembly mounting mechanism.

FIG. 28A is a schematic illustrative view showing a state where the toner bottle of this embodiment is going to be set onto the toner supply assembly mounting mechanism; FIG. 28B is a schematic illustrative view showing a state where the toner bottle is being set on the toner supply assembly mounting mechanism; and FIG. 28C is a schematic illustrative view showing a state where the toner bottle has been completely set on the toner supply assembly mounting mechanism.

When toner bottle 200 is set on toner supply assembly mounting mechanism 600*a*, a toner container mounting door 810 is opened first, toner bottle 200 is then inserted into the machine so that toner bottle 200 is moved approximately parallel to the top (attachment portion) of toner supply assembly mounting mechanism 600*a* along the toner bottle 200's axial direction, as shown in FIG. 28A.

As toner bottle 200 moves and begins its mounting to toner supply assembly mounting mechanism 600*a*, engagement piece 219 of toner bottle 200 abuts rib 632 of inlet slide shutter 631 of toner supply assembly mounting mechanism 600*a* while rib 217 of outlet slide shutter 216 of toner bottle 200 abuts engagement piece 634 of toner supply assembly mounting mechanism 600*a*, as shown in FIG. 28B.

As toner bottle 200 further advances, inlet slide shutter 631 on the toner supply assembly mounting mechanism 600*a* side is pushed by engagement piece 219 and moves opposing the repulsive force of spring element 633, in the direction that permits toner feed port 611*a* to open.

On the other hand, outlet slide shutter 216 on toner bottle 200 side is stopped from moving as rib 217 abuts engagement piece 634. Therefore, the shutter 216 relatively moves as toner bottle 200 advances opposing the repulsive force of spring element 218, in the direction that permits toner discharge port 215 to open.

Then, as toner bottle 200 is completely set to toner supply assembly mounting mechanism 600*a*, inlet slide shutter 631 on the toner supply assembly mounting mechanism 600*a* side is caused by engagement piece 219 to open toner feed port 611*a* while outlet slide shutter 216 of toner bottle 200 is caused by engagement piece 634 to open toner discharge port 215, as shown in FIG. 28C.

By this action, toner feed port 611*a* on the toner bottle 200 side and toner discharge port 215 on the toner supply assembly mounting mechanism 600*a* side are made to communicate with each other, so that toner can be fed from toner bottle 200 into toner supply assembly mounting mechanism 600*a*.

Finally, as toner container mounting door 810 is closed, the mounting of toner bottle 200 into the apparatus is completed.

When toner bottle 200 is dismounted from toner supply assembly mounting mechanism 600*a*, the above operation is performed in reverse in the order from FIG. 28C to FIG. 28A. That is, when toner bottle 200 is removed from toner supply assembly mounting mechanism 600*a*, in toner bottle 200 outlet slide shutter 216 is moved in the direction for closing toner discharge port 215 by the repulsive force of spring element 218, so that toner discharge port 215 is closed by outlet slide shutter 216.

On the other hand, in toner supply assembly mounting mechanism 600*a*, inlet slide shutter 631 is moved in the direction for closing toner feed port 611*a* by the repulsive force of spring element 633, so that toner feed port 611*a* is closed by inlet slide shutter 631.

With this configuration, it is possible to close toner discharge port 215 at any time when toner bottle 200 is handled alone, hence there is no fear of spilling toner powder.

Now, a characteristic configuration of toner supply device 100 will be described with reference to the drawings.

As shown in FIG. 1, housing (exterior) 1*a* of image forming apparatus 1 with toner supply devices 100 has a plurality of toner container mounting doors (toner container covering structure) 810 (810*a*1, 810*a*2, 810*b*, 810*c* and 810*d*), which each allow toner bottle 200 to be fitted in and removed.

Image forming apparatus 1 has a control portion CON for input control, in which a display portion DS of a LCD panel is usually used. Here, the control portion CON may employ a touch panel configuration so that control portion CON and display portion DS are integrated.

The layout of toner container mounting doors 810 is not particularly limited as long as toner bottles 200 can be mounted and removed therethrough. Still it is preferred that they are arranged at such positions that allow the user using image forming apparatus 1 to visually grasp whether toner container mounting doors 810 are open or closed. For example, toner container mounting doors 810 may be laid out at a place that opposes the user who operates control portion CON or checks display portion DS (to be described in short as "who uses image forming apparatus 1"). That is, the user who uses image forming apparatus 1 of FIG. 1 can grasp the conditions of toner container mounting doors 810, whether they are open or not, by visual observation. Also, if toner container mounting doors 810 are arranged on one side surface of image forming apparatus when viewed from the user who uses image forming apparatus 1, the user is able to visually check whether container mounting doors 810 are open or not.

Alternatively, toner container mounting doors 810 may be arranged at a place where their open and closed conditions cannot be visually checked by the user who uses image forming apparatus 1. In this case, a sound, warning display or any other indication can be used to inform the user of the open or closed conditions of toner container mounting doors 810.

In the toner container covering structure 810 shown in FIG. 1, a plurality of doors are provided corresponding to multiple toner bottles 200 of different colors. That is, in the present embodiment there are five separate toner container mounting doors 810*a*1, 810*a*2, 810*b*, 810*c* and 810*d* for five toner bottles BK, BK, C, M and Y.

As shown in FIGS. 28A to 28C, each toner container mounting door 810 is pivotally supported with its first end side 811*a* located at top as a free end and its second end side 811*b* located at bottom as a pivot axis 811*c*, so that the first end side 811*a* can pivotally open outside and downward. A magnet 812 is arranged at first end side 811*a* of toner container mounting door 810, so that first end side 811*a* can be attached to and detached from housing 1*a* in a simple structure.

Pivot axis 811*c* at second end side 811*b* is coupled to an unillustrated drive motor or actuator. This drive motor or actuator is controlled to operate in accordance with the signal output from micro switch 211*a* inside toner bottle 200 and is caused to operate to open toner container mounting door 810 when the amount of toner left in toner bottle 200 has become low.

Also, toner container mounting door 810 is provided with a toner container mounting door detecting sensor SE1 that detects whether toner container mounting door 810 is open or not. This toner container mounting door detecting sensor is adapted to detect the body of the toner container mounting door itself. However, toner container mounting door detecting sensor SE1 may detect the status of pivot axis 811*c* (its rotated status etc.). Alternatively, toner container mounting door detecting sensor SE1 employ a contact type (mechanical type) sensor, a non-contact type sensor or any other type as long as it can detect the status of toner container mounting door 810 and the like. More specifically, toner container mounting door detecting sensor SE1 may be configured of a micro switch (contact type) or a photo sensor (non-contact type).

Further, in the embodiment an indication of shortage in remaining toner is adapted to be displayed on display portion DS when the amount of toner left in toner bottle 200 has been reduced to a predetermined volume or lower.

The means for warning the shortage in the toner left in toner bottle 200 is not limited to the above. For example, a rotating light or other kinds of lamps that give visual warning may be used or warning sound (including voice sound) may be used to appeal to the ear.

Next, a control method of driving toner containers in toner supply devices 100 during a printing operation of image forming apparatus 1 according to the present embodiment will be described with reference to a flow chart.

FIG. 29 is a flow chart showing a toner supply operation based on a toner container drive control method for the toner supply devices according to the present embodiment.

In image forming apparatus 1 according to the present embodiment, toner supply and replacement of toner bottles 200 are performed by controlling the rotational operations of toner bottles 200 in toner supply devices 100 in accordance with the sequence as follows.

To begin with, as a print request is made (Step S1), an initializing step (initialization of photoreceptor drums, initialization of the sensors, restoration of the drive portions to their home positions and warm-up of the fixing unit and other processes) is executed (Step S2). Also, in this initialization process, it is checked whether any of multiple toner bottles 200 is short of toner (empty), by means of switches 211*a* (FIG. 28) provided for every toner bottle 200 (Step S3).

At Step S3, if no micro switch 211*a* (FIG. 28) has detected a shortage of toner, that is, when no empty toner bottle 200 has been detected, the initialing process is ended (Step S4), then the printing operation is started (Step S5). When the printing operation is completed (Step S5), it is checked whether there is a next print request (Step S6). If there is a print request at Step S6, the operation goes to Step S3, the amount of toner left in each toner bottle 200 is checked, and the apparatus continues the printing operation. When there is no print request, the apparatus set into a waiting mode.

On the other hand, when an empty toner bottle is detected by any of micro switches 211*a* at Step S3, a message giving an indication of replacement of the associated toner bottle 200 is displayed on display portion DS, at the same time the toner container compartment door 810 corresponding to the toner bottle 200 that is short of toner is opened (Step S7). Step S7 ends when toner container mounting door detecting sensor SE1 detects that toner container mounting door 810 has been closed after replacement of toner bottle 200. Then, the initializing step ends (Step S8).

Next, as to the toner bottle 200 that was newly mounted at Step S7, it is determined whether a printing operation using that toner will cause any adverse influence on the toner concentration and color in the developing hopper (Step S9). At Step S9, the propriety of toner bottle 200 can be determined based on a tag T that is recorded with the information on the toner (color, concentration) in toner bottle 200 and the manufacturer and the like as well as the information from the concentration sensor in toner bottle 200.

At Step S9, if it is determined that the toner bottle in question will cause adverse influence on the toner concentration and color, a message for recommending the replacement of the toner bottle 200 in question is displayed on display portion DS of the apparatus (Step S10). In this case, image forming apparatus 1 is set into a waiting mode in which the operation is stopped (Step S11).

On the other hand, at Step S9, if it is determined that no adverse influence on the toner concentration and color will occur, all the toner bottles 200 are caused to rotate (Step S12) to perform a printing operation (Step S13).

Then, in parallel with the printing operation, empty detection of the toners in multiple toner bottles 200 is performed (Step S14). At this stage, toner container mounting door(s) 810 corresponding to the empty detected toner bottle(s) 200 is open.

At Step S14, if there is any empty bottle detected, drive mechanisms 701 (701*a* to 701*d*: FIG. 5) are controlled so as to stop the rotational operation of the toner bottle(s) 200 alone, which is determined to be empty (Step S15).

Then, replacement of toner bottle(s) 200 is performed again (Step S16). Step S16 includes the process at Step S9.

In the present embodiment, during the replacement work of a toner bottle 200 that was detected as being empty (Steps S15 and S16), only the toner bottle 200 is stopped from rotating while the other system components are kept on to continue the printing operation in progress. As to the toner to be supplied from the toner bottle 200 that was detected as being empty, the toner that has been stored inside developing unit 23 (FIG. 2) can be used during this period to continue the printing operation in progress.

After completion of the replacement work of toner bottle 200, it is determined whether toner container mounting door 810 has been closed or not based on toner container mounting door detecting sensor SE1 (Step S17).

If toner container mounting door 810 has been closed, the operation goes to Step S13, and the newly replaced toner bottle 200 starts to be rotated to continue the printing operation.

Then, it is checked whether there is a next print request (Step S6); if there is, the operation goes to Step S3, where the amount of toner left is checked for every toner bottle, then followed by execution of the printing operation. If there is no print request, the operation enters a waiting mode.

In the above way, the printing operation and check on remaining toner quantities and replacement of toner bottles 200 in image forming apparatus 1 can be implemented.

As configured as above, according to the present embodiment, when the toner in one of toner bottles 200 has run out, the corresponding toner container mounting door 810 automatically opens (Steps S7 and S14), so that the above operation sequence in the supply device 100 makes it possible to simply inform the user or operator of a shortage of remaining toner in a visual manner. Further, since the toner container mounting door 810 corresponding to the toner bottle 200 that has been detected as being empty is opened, the user or operator can easily know the toner bottle 200 that needs to be replaced among the plurality of toner bottles 200 (Steps S7 and S14).

Further, according to the present embodiment, since the operation control is performed such that the toner bottle 200 that has been detected as being empty is stopped from rotating (Step S15), this facilitates replacement of the toner bottle 200 without undergoing any scatter of unused toner left therein inside the apparatus.

Moreover, according to the present embodiment, during the replacement work of the toner bottle 200 that has been detected as being empty (Steps S15 and S16), the toner bottle 200 in question alone is stopped from rotating while the other system components continue to operate for the printing operation in progress. Accordingly, it is possible to achieve an efficient printing operation.

Furthermore, according to the present embodiment, as a remaining toner quantity detecting means for detecting the amount of toner left in toner bottle 200, partitioning plate 213 that is provided to adjust the volume of toner storing compartment 211 in which toner is stored is used so that it can be detected by micro switch 211*a* arranged inside toner bottle 200, it is therefore possible to correctly detect a shortage of remaining toner with a simple structure, hence detect empty toner bottles 200.

However, the remaining toner quantity detecting means should not be limited to the above configuration. For example, instead of using micro switch 211*a* for direct detection, a non-contact type sensor may be used to detect the position of partitioning plate 213 from the outside of toner bottle 200, or any other method may be used for the detection.

The configuration of toner container mounting doors (toner container covering structure) 810 are not limited to the above embodiment. For example, the portion in which all the toner bottles 200 are mounted may be opened integrally. Such a configuration can not only simplify the configuration of the toner container mounting door (toner container covering structure) but also enables all the mounted toner bottles 200 to be checked at once when it is open. As a result, it is possible to grasp the toner bottle(s) 200 needing to be stopped and replaced at first sight.

Though the present embodiment has been described taking an example in which toner supply devices 100 using toner bottles 200 are applied to the image forming apparatus 1 shown in FIG. 1, the present technology should not be limited to the above and can be applied to any kinds of image forming apparatuses as long as they include equivalent toner supply devices and a developing unit.

Figure 30:
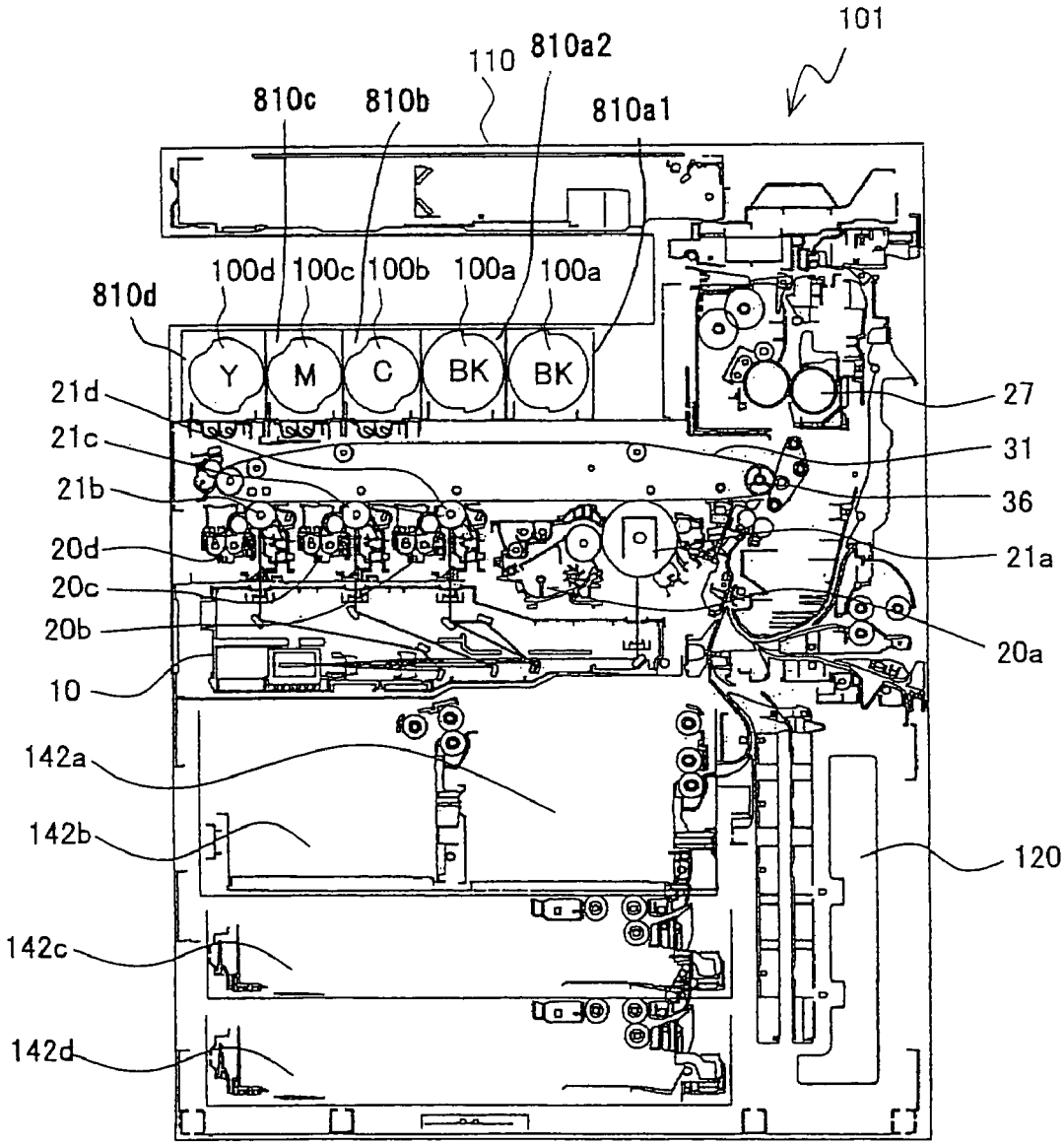

As another embodiment mode, the technology may be applied to a copier 101 shown in FIG. 30, for example.

As shown in FIG. 30, copier 101 has almost the same configuration as that of image forming apparatus 1 according to the embodiment described above, and includes an image reader (scanner) 110 disposed above an image forming portion 108 having toner bottles 200, first, second, third and fourth paper feed cassettes 142*a*, 142*b*, 142*c* and 142*d* disposed under image forming portion 108 for supporting multiple kinds of paper, so as to deal with a variety of and a large amount of automatic printing. In the drawing, a reference numeral 120 designates a waste toner box for collecting waste toner.

Here, in copier 101, the same components as those in image forming apparatus 1 of the above-described embodiment will be allotted with the same reference numerals without description.

The printing operation and toner supply operation by toner supply devices 100 in the thus constructed copier 101 are performed in the same manner as in the image forming apparatus 1 of the above embodiment.

Accordingly, similarly to the above-described image forming apparatus 1, the operational control of copier 101 is carried out by checking the amount of toner left in toner bottle 200 of each toner supply device 100 so as to stop the rotational operation of the toner bottle(s) 200 which is short of toner, i.e., detected as being empty. Hence, the user or operator is able to easily know a shortage of toner left in the bottle and hence can make replacement of toner bottle 200 without undergoing any scatter of unused toner inside the apparatus.

Further, the technology can be developed into any form of other kinds of image forming apparatuses etc., not limited to the thus configured image forming apparatus 1 and copier 101, as long as it is an image forming apparatus needing a supply of developer (toner).

As has been described above, the present technology should not be limited to the above embodiment and example and various changes can be made within the range specified in the scope of claims. That is, any embodied mode obtained by combination of technical means modified as appropriate without departing from the spirit and scope of the present technology should be included in the technical art of the present technology.

What is claimed is:

1. A control method of driving toner containers for use in an apparatus including a plurality of toner containers each filled with toner and detachably mounted thereinto from a toner container covering structure; and a toner supply device for supplying toner to a developing unit while rotating the plurality of toner containers, comprising the steps of:

detecting a first toner container whose toner has run out, among the plurality of toner containers;

automatically opening the toner container covering structure when the first toner container has been detected as empty;

stopping the rotational motion of the first toner container when the first toner container has been detected as empty; and, continuing the rotational motion of a second toner container or containers other than the first toner container when the first toner container has been detected as empty.

2. The control method of driving toner containers according to claim 1, further comprising:

continuing a printing operation including a developing process by the developing unit, under the condition in which the first toner container is being stopped from rotating.

3. The control method of driving toner containers according to claim 1, further comprising:

continuing a printing operation including a developing process by the developing unit while the first toner container is removed from the apparatus and a replacement toner container is mounted to the apparatus through the toner container covering structure, under the condition in which the first toner container is being stopped from rotating.

4. The control method of driving toner containers according to claim 1, wherein detecting a first toner container whose toner has run out comprises receiving a signal from a detector located within the toner container.

5. The control method of driving toner containers according to claim 1, further comprising:

replacing the toner container that has been detected as being empty with a new toner container;

reading information about the toner contained in the new toner container from an electronic memory module attached to the new toner container; and determining whether the toner in the new toner container is appropriate for conducting image forming operations.

6. The control method of driving toner containers according to claim 5, further comprising stopping all image forming steps and issuing an error message if the results of the determining step indicate that the toner in the new toner container is not appropriate for conducting image forming operations.

7. The control method of driving toner containers according to claim 5, wherein during the replacing step, as the first toner container is removed from the apparatus, the removal action causes a shutter on the first toner container to close a toner discharge port of the first toner container, and wherein the action of installing the new toner container causes a shutter on the new toner container to open a toner discharge port of the new toner container.

8. The control method of driving toner containers according to claim 7, wherein during the replacing step, as the first toner container is removed from the apparatus, the removal action also causes a shutter to close a toner input port of the toner supply device, and wherein the action of installing the new toner container causes the shutter to open the toner input port of the toner supply device.

9. An image forming apparatus, including:

a developing unit;

a plurality of toner containers each filled with toner;

a remaining quantity detector for detecting the amount of the toner left in each toner container;

a toner feed portion to which the toner container is mounted, for delivering the toner discharged from the toner container to the developing unit; and a toner container covering structure, characterized in that the plurality of toner containers can be detachably mounted to the toner feed portion through the toner container covering structure from the outside of the apparatus, the plurality of toner containers feed the toner to the developing unit while they are being rotated, and wherein when a first toner container whose toner has run out is detected by the remaining quantity detector, the toner container covering structure is automatically opened and the rotational motion of the first toner container is stopped while the rotational motion of a second toner container or containers other than the first toner container is continued.

10. The image forming apparatus according to claim 9, wherein a printing operation including a developing process by the developing unit is continued under the condition in which the first toner container is being stopped from rotating.

11. The image forming apparatus according to claim 9, wherein a printing operation including a developing process by the developing unit is continued when the first toner container is removed from the apparatus and a new toner container is mounted to the apparatus through the toner container covering structure, under the condition in which the first toner container is being stopped from being rotated.

12. The image forming apparatus according to claim 9, wherein the remaining quantity detector receives signals from each of the plurality of toner containers and uses those signals to determine the amount of toner left in each container.

13. The image forming apparatus according to claim 9, wherein the toner feed portion includes a movable shutter that covers a toner input port of the toner feed portion, wherein removing the first toner container causes the shutter to close the toner input port, and wherein installing a new toner container causes the shutter to open the toner input port.

14. The image forming apparatus according to claim 9, further comprising a toner information receiving unit that reads information about the toner in the toner containers from electronic memory modules installed on the toner containers.

* * * * *